US010018345B2

(12) United States Patent
Zou et al.

(10) Patent No.: US 10,018,345 B2
(45) **Date of Patent: *Jul. 10, 2018**

(54) LED KIT

(71) Applicant: Green Inova Lighting Technology (Shenzhen) Limited, Shenzhen, Guangdong (CN)

(72) Inventors: Xiaofeng Zou, Shenzhen (CN); Qiang Li, Shenzhen (CN); Zhijin Lin, Shenzhen (CN)

(73) Assignee: Green Inova Lighting Technology (Shenzhen) Limited, Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/470,302

(22) Filed: Mar. 27, 2017

(65) Prior Publication Data

US 2017/0336062 A1 Nov. 23, 2017

Related U.S. Application Data

(63) Continuation of application No. 15/161,970, filed on May 23, 2016, now Pat. No. 9,605,840.

(51) Int. Cl.
*F21V 21/30* (2006.01)
*F21V 29/02* (2006.01)
(Continued)

(52) U.S. Cl.
CPC ..... *F21V 29/673* (2015.01); *F21V 17/12* (2013.01); *F21V 21/30* (2013.01); *F21V 23/001* (2013.01);
(Continued)

(58) Field of Classification Search
CPC ..... F21Y 2105/10; F21Y 2115/10; F21Y 2113/00; F21Y 2103/10; F21K 9/23;
(Continued)

(56) References Cited

U.S. PATENT DOCUMENTS 7,131,753 B1 * 11/2006 Edwards, Jr. ..... F21S 2/005 362/11
7,213,940 B1 5/2007 Van De Ven et al.
(Continued)

FOREIGN PATENT DOCUMENTS

WO 2015076258 A1 5/2015

*Primary Examiner* — Vibol Tan
(74) *Attorney, Agent, or Firm* — Meunier Carlin & Curfman LLC

(57) ABSTRACT

Various implementations of an LED kit include a housing and at least one LED unit. The LED unit is coupled to an outer surface of at least one wall of the housing. Inner surfaces of the housing walls define a channel that includes a first opening at one end of the housing and a second opening at the other end of the housing. A central axis of the channel is orthogonal to a light output direction of the LED unit. A heat sink structure extends from the inner surface of at least one of the walls, and at least one electrically powered cooling device (e.g., a fan) is disposed adjacent the first opening. The cooling device causes air to flow through the channel from the first opening to the second opening, or vice versa, along the central axis and across the heat sink structure orthogonally to the light output direction.

20 Claims, 37 Drawing Sheets

(51) Int. Cl.

| | |
|---|---|
| ***F21V 29/67*** | (2015.01) |
| ***F21V 29/74*** | (2015.01) |
| ***F21V 29/83*** | (2015.01) |
| ***F21V 17/12*** | (2006.01) |
| ***F21V 23/00*** | (2015.01) |
| ***H05B 33/08*** | (2006.01) |
| ***H05B 37/02*** | (2006.01) |
| *F21Y 115/10* | (2016.01) |
| *F21Y 105/10* | (2016.01) |
| *F21Y 107/20* | (2016.01) |

(52) U.S. Cl.
CPC ..... *F21V 23/003* (2013.01); *F21V 23/005* (2013.01); *F21V 29/74* (2015.01); *F21V 29/83* (2015.01); *H05B 33/0842* (2013.01); *H05B 37/0227* (2013.01); *F21Y 2105/10* (2016.08); *F21Y 2107/20* (2016.08); *F21Y 2115/10* (2016.08)

(58) Field of Classification Search
CPC ..... F21K 9/00; F21V 29/677; F21V 29/83; F21V 23/0442; F21V 29/02; F21V 29/74; F21V 29/67; F21V 29/763; F21V 15/01; F21V 23/04; F21V 29/20; F21V 29/508; F21V 29/004; F21V 29/00; F21V 29/006; F21V 29/503; F21V 29/75; F21V 29/76; F21V 29/767; F21V 29/777; Y10S 362/80; H05B 33/0812; H05B 33/0815; H05B 33/0872
See application file for complete search history.

(56) References Cited

U.S. PATENT DOCUMENTS

| | | | | |
|---|---|---|---|---|
| 7,476,001 | B2 * | 1/2009 | Lanczy | F21V 21/02 362/150 |
| 7,534,015 | B2 | 5/2009 | Yu et al. | |
| 7,581,856 | B2 | 9/2009 | Tsai et al. | |
| 7,593,229 | B2 | 9/2009 | Shuy | |
| 7,828,460 | B2 | 11/2010 | Van De Ven et al. | |
| 7,993,031 | B2 | 8/2011 | Grajcar | |
| 8,066,414 | B2 | 11/2011 | Pabst et al. | |
| 8,123,381 | B1 * | 2/2012 | Wray | F21V 23/005 362/294 |
| 8,319,408 | B1 | 11/2012 | Horng | |
| 8,487,517 | B2 | 7/2013 | Fang et al. | |
| 8,513,875 | B2 | 8/2013 | Van De Ven et al. | |
| 8,529,099 | B2 | 9/2013 | Yang | |
| 8,610,339 | B2 | 12/2013 | Fang | |
| 8,619,408 | B2 | 12/2013 | Sherwood et al. | |
| 8,674,626 | B2 | 3/2014 | Siemiet et al. | |
| 8,680,754 | B2 | 3/2014 | Premysler | |
| 8,960,965 | B2 | 2/2015 | Horng | |
| 8,979,304 | B2 | 3/2015 | Mart et al. | |
| 9,028,129 | B2 * | 5/2015 | McCollum | F21V 29/77 362/628 |
| 9,030,120 | B2 | 5/2015 | Van De Ven et al. | |
| 9,084,328 | B2 | 7/2015 | Negley et al. | |
| 9,091,424 | B1 | 7/2015 | Mart et al. | |
| 9,103,540 | B2 * | 8/2015 | Wyrick | H05B 33/0803 |
| 9,115,876 | B1 | 8/2015 | Mart | |
| 9,200,794 | B2 * | 12/2015 | Clifford | F21V 29/02 |
| 9,243,758 | B2 | 1/2016 | Pickard | |
| 9,243,792 | B2 | 1/2016 | Horng | |
| 2005/0174780 | A1 | 8/2005 | Park | |
| 2010/0328949 | A1 | 12/2010 | Lai et al. | |
| 2011/0075433 | A1 | 3/2011 | Mart et al. | |
| 2012/0218769 | A1 | 8/2012 | Van Horn et al. | |

* cited by examiner

LED KIT

CROSS REFERENCE TO RELATED APPLICATION

This application is a continuation application of U.S. patent application Ser. No. 15/161,970, filed May 23, 2016, entitled "LED KIT," the content of which is herein incorporated by reference in its entirety.

BACKGROUND

Light emitting diode (LED) based light bulbs are more energy efficient, have a longer life, and have less environmental impact than more traditional types of bulbs, such as fluorescent or halogen bulbs. Thus, LED based light bulbs are becoming more popular.

Traditional bulbs have been installed in light fixtures that are designed to help dissipate the heat generated by the traditional bulbs. However, LED bulbs that are mounted within existing light fixtures may not be able to dissipate heat through the same mechanisms as traditional bulbs. If the LEDs generate too much heat, the heat can damage the LEDs and/or the circuitry that controls the LEDs. Thus, the temperature of the LED light bulbs needs to be regulated.

Accordingly, there is a need in the art for improved cooling mechanisms for regulating the temperature of LED light bulbs.

BRIEF SUMMARY

According to various implementations, an LED kit includes a housing and at least one LED unit. The housing has a plurality of walls, and each wall has an inner and an outer surface. The inner and outer surfaces of each wall are opposite and spaced apart from each other. The at least one LED unit is coupled to the outer surface of at least one wall of the housing. At least a portion of the inner surfaces of the walls define a channel, and the channel has a first opening at a first end of the housing and a second opening at a second end of the housing. The first and second ends of the housing are spaced apart and opposite each other, and a central axis of the channel is orthogonal to a direction of light output from the at least one LED unit. At least one heat sink structure extends from the inner surface of at least one of the walls. At least one electrically powered cooling device is disposed adjacent the first opening of the housing. The electrically powered cooling device causes air to flow through the channel from one of the first or second opening of the housing to the other of the second or first opening along the central axis and across the heat sink structure. The air flow direction is orthogonal to the light output direction.

In some implementations, the electrically powered cooling device is a fan, and a plane in which the fan rotates is parallel to the light output direction. In other implementations, the electrically powered cooling device includes a first fan and a second fan disposed adjacent the first opening, and a first plane in which the first fan rotates and a second plane in which the second fan rotates are parallel to the light output direction. Alternatively, the first fan may be disposed adjacent the first opening and the second fan may be disposed adjacent the second opening, and the first plane in which the first fan rotates and the second plane in which the second fan rotates are parallel to the light output direction.

In some implementations, the heat sink structure includes fins. For example, in some implementations, the fins extend from the inner surfaces of the first and second side walls.

In some implementations, the walls of the housing include a third wall and a fourth wall. The third and fourth walls lie in planes that are orthogonal to the planes in which the first and second walls lie, and the heat sink structure extends from the inner surfaces of the first, second, third, and fourth side walls. In further or alternative implementations, the walls include fifth, sixth, seventh, and eighth walls. The fifth wall is between the first and third walls, the sixth wall is between the third and second walls, the seventh wall is between the second and fourth walls, and the eighth wall is between the fourth and first walls. The first and second openings are octagonally shaped. In a further implementation, the LED unit is a first LED unit disposed on the outer surface of the first wall, and the at least one LED unit further includes a second LED unit disposed adjacent the fifth wall and a third LED unit disposed adjacent the sixth wall.

In some implementations, the at least one LED unit is coupled to the outer surface of the first wall, and the LED kit further includes a bracket coupled to the outer surface of a second wall that is opposite and spaced apart from the first wall. The bracket may include a first L-shaped bracket that is coupled to the outer surface of the second wall and a second L-shaped bracket that is coupled to the first L-shaped bracket. The bracket may also include a base bracket directly coupled to the outer surface of the second wall. The central portion of the base bracket is spaced apart from the outer surface of the second wall, and a first leg of the first L-shaped bracket is insertable between the central portion of the base bracket and the outer surface of the second wall. The first L-shaped bracket may have a first axis that extends orthogonally to the outer surface of the second wall, and the second L-shaped bracket may have a second axis and is coupled to the first L-shaped bracket such that the second axis is at an angle of about 180° or less to the first axis. The bracket may also include a third L-shaped bracket that is coupled to the second L-shaped bracket. The third L-shaped bracket is mountable to a light fixture by engaging a screw into each of one or more openings defined by the third L-shaped bracket and the light fixture.

In some implementations, the housing may include an inner wall that extends between the inner surfaces of the first wall and the second wall. The inner wall divides the channel into a first channel and a second channel. In one implementation, a first fan is disposed adjacent the first opening of the first channel, and a second fan is disposed adjacent the first opening of the second channel.

In some implementations, the LED kit further includes a driver. The driver has alternating circuit power input wires, direct current power output wires, and a circuit there between for converting alternating current to direct current. The driver is separate from the housing, and the direct current power output wires of the driver are electrically coupled to direct current input wires that provide direct current power to the LED unit and the electrically powered cooling device.

In some implementations, the housing also includes a first temperature control circuit and a second temperature control circuit. The first temperature control circuit includes a first temperature switch associated with a first activation temperature and a first threshold temperature. The second temperature control circuit includes a second temperature switch associated with a second activation temperature and a second threshold temperature. The first activation temperature is lower than the second activation temperature, and the first temperature control circuit reduces an amount of current to the at least one LED unit by a first amount in response to the first temperature switch sensing a housing temperature higher than the first activation temperature. The second temperature control circuit reduces the amount of current by a second amount in response to the second temperature switch sensing the housing temperature is higher than the second activation temperature. The housing may also include a third temperature control circuit. The third temperature control circuit includes a third temperature switch associated with a third activation temperature, and the third activation temperature is higher than the second activation temperature. The third temperature control circuit reduces the amount of current to the at least one LED unit by a third amount in response to the third temperature switch sensing the housing temperature is higher than the third activation temperature.

According to various other implementations, an LED kit includes a housing and at least one LED unit. The housing has a plurality of walls, and each wall has an inner and an outer surface. The inner and outer surfaces of each wall are opposite and spaced apart from each other. The at least one LED unit is coupled to the outer surface of at least one wall of the housing. The housing further includes a first temperature control circuit and a second temperature control circuit. The first temperature control circuit includes a first temperature switch associated with a first activation temperature. The second temperature control circuit includes a second temperature switch associated with a second activation temperature. The first activation temperature is lower than the second activation temperature. The first temperature control circuit reduces an amount of current to the at least one LED unit by a first amount in response to the first temperature switch sensing a housing temperature higher than the first activation temperature, and the second temperature control circuit reduces the amount of current by a second amount in response to the second temperature switch sensing the housing temperature is higher than the second activation temperature.

In some implementations, the housing includes a third temperature control circuit. The third temperature control circuit includes a third temperature switch associated with a third activation temperature. The third activation temperature is higher than the second activation temperature, and the third temperature control circuit reduces the amount of current to the at least one LED unit by a third amount in response to the third temperature switch sensing the housing temperature is higher than the third activation temperature. In addition, the first temperature control switch may be associated with a first threshold temperature, the second temperature control switch may be associated with a second threshold temperature, and the third temperature control switch may be associated with a third threshold temperature. The third threshold temperature is higher than the second threshold temperature, and the second threshold temperature is higher than the first threshold temperature. The third temperature control circuit ceases reducing the amount of current to the at least one LED unit by the third amount in response to the housing temperature being lower than the third threshold temperature. The second temperature control circuit ceases reducing the amount of current to the at least one LED unit by the second amount in response to the housing temperature being lower than the second threshold temperature. And, the first temperature control circuit ceases reducing the amount of current to the at least one LED unit by the first amount in response to the housing temperature being lower than the first threshold temperature. In some implementations, each of the first, second, and third temperature control circuits includes a resistance integrated circuit that reduces current through the respective temperature control circuit, and the first, second, and third temperature control circuits are arranged in series.

BRIEF DESCRIPTION OF THE DRAWINGS

Various implementations of the LED kit are explained in even greater detail in the following exemplary drawings. The drawings are merely exemplary to illustrate the structure of the LED kit and certain features that may be used singularly or in combination with other features. The invention should not be limited to the implementations shown.

DETAILED DESCRIPTION

Figure 1:
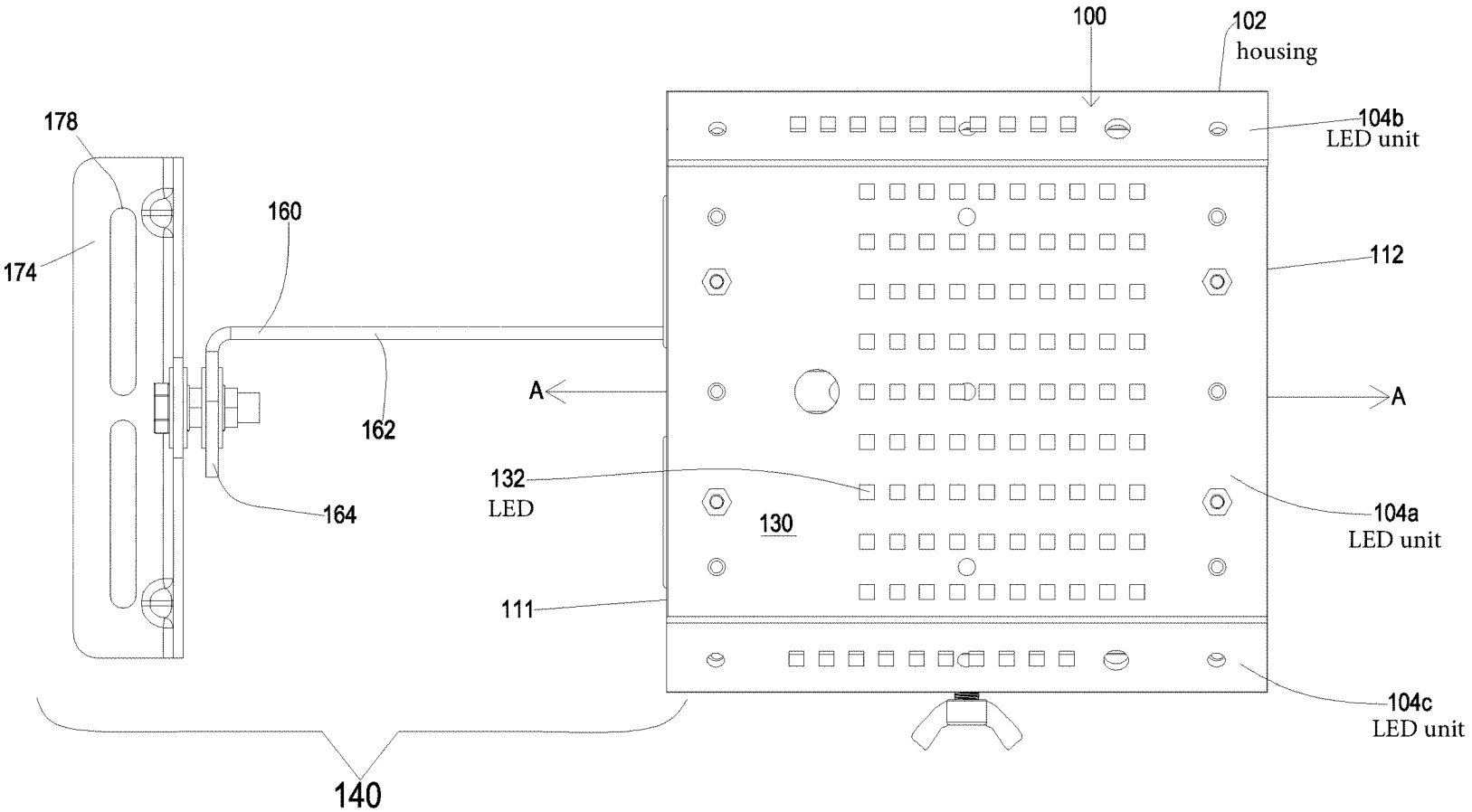
FIG. 1 illustrates a front view of an LED kit according to one implementation.

Various implementations of an LED kit include a housing and at least one LED unit. The LED unit is coupled to an outer surface of at least one wall of the housing. Inner surfaces of the housing walls define a channel that includes a first opening at one end of the housing and a second opening at the other end of the housing. A central axis of the channel is orthogonal to a light output direction of the LED unit. A heat sink structure extends from the inner surface of at least one of the walls, and at least one electrically powered cooling device (e.g., a fan) is disposed adjacent the first opening. The cooling device causes air to flow through the channel from the first opening to the second opening, or vice versa, along the central axis and across the heat sink structure orthogonally to the light output direction.

FIGS. 1-5 illustrate an LED kit 100 according to one implementation. The kit 100 includes a housing 102 and three LED units 104*a*, 104*b*, and 104*c*. The housing 102 includes eight side walls 106*a*-106*h*, and each side wall 106*a*-106*h* has an inner surface 108 and an outer surface 109. The inner 108 and outer surfaces 109 of each side wall 106*a*-106*h* are opposite and spaced apart from each other. The inner surfaces 108 of the side walls 106*a*-106*h* define a channel 110. The channel 110 has a first opening at a first end 111 of the housing 102 and a second opening at a second end 112 of the housing 102. The first end 111 and the second end 112 are opposite and spaced apart from each other. A central axis A-A extends through the channel 110.

At least one heat sink structure extends from the inner surface 108 of at least one side wall 106*a*-106*h* to conduct heat from the housing 102 into the channel 110. In addition, at least one electrically powered cooling device is disposed adjacent one or both of the openings of the channel 110 to cause air to flow through the channel 110 from one opening to the other opening along the axis A-A and across the heat sink structure and convectively cool the heat sink structure. The heat sink structure may include fins, for example, that extend partially or fully along the channel 110 in the direction of the central axis A-A. The electrically powered cooling device may include a fan or a diaphragm, for example.

For example, in the implementation shown in FIGS. 1-4, the heat sink structure includes ten fins 116*a*-116*j*. Fins 116*a* and 116*e* extend between the inner surfaces 108 of side walls 106*a* and 106*e*, are centrally disposed within the channel 110, and are parallel and spaced apart from each other on either side of the central axis A-A. Fin 116*f* extends from the inner surface 108 of side wall 106*c* and intersects a central portion of fin 116*a*. Fin 116*c* extends from the inner surface 108 of side wall 106*g* and intersects a central portion of fin 116*e*. Fin 116*b* is disposed between fin 116*e* and the inner surfaces 108 of side walls 106*g* and 106*h*, and fin 116*b* extends between the inner surface 108 of side wall 106*a* and fin 116*c*. Fin 116*d* is disposed between fin 116*a* and the inner surfaces 108 of side walls 106*b* and 106*c*, and fin 116*d* extends between the inner surface 108 of side wall 106*a* and fin 116*f*. Fin 116*g* is disposed between fins 116*b* and 116*e* and extends between the inner surface 108 of side wall 106*a* and fin 116*e*. Fin 116*h* is disposed between fins 116*d* and 116*a* and extends between the inner surface 108 of side wall 106*a* and fin 116*a*. Fin 116*i* is disposed between fin 116*e* and the inner surface 108 of side walls 106*f* and 106*g*, and fin 116*i* extends between the inner surface 108 of side wall 106*e* and fin 116*e*. Fin 116*j* is disposed between fin 116*a* and the inner surfaces 108 of side walls 106*c* and 106*d*, and fin 116*j* extends between the inner surface 108 of side wall 106*e* and fin 116*a*.

The arrangement of the fins may vary depending on the amount of power supplied to the LEDs and the number of fans used to move air through the channel 110. Exemplary implementations having alternative fin arrangements are described below in reference to FIGS. 14-28.

The implementation shown in FIGS. 1-4 and 6-10 includes a fan 120 that is coupled to one end of the housing 102. The fan 120 may be coupled to the housing using screws or other suitable fastening mechanism. As shown, a portion of each of fins 116*g*, 116*i*, 116*j*, and 116*h* defines a boss 122. Screws (not shown) are threadingly engaged through openings 124 defined in the fan frame 126 that are aligned with the bosses 122 to couple the fan 120 to one end of the housing 102. The fan 120 rotates in a plane that is orthogonal to the central axis A-A and causes air to flow through the channel 110 across the fins 116*a*-116*j* to reduce the temperature of the housing 102 and any LED units coupled thereto.

Each LED unit 104*a*, 104*b*, 104*c* includes a plate 130 and a plurality of LEDs 132 coupled to the plate 132. The LED unit 104*a* is coupled to the outer surface 109 of side wall 106*a*. For example, LED unit 104*b* is coupled to the outer surface 109 of side wall 106*h*, and LED unit 104*c* is coupled to the outer surface 109 of side wall 106*b*. The LED units 104*a*, 104*b*, 104*c* may be coupled to side walls 106*a*, 106*b*, 106*h*, respectively, using one or more screws or other suitable fastening mechanisms. In addition, in some implementations, the LED kit may include one or more LED units coupled to one or more side walls. And, in some implementations, the LED unit may include just the LED(s) 132. In some implementations, the plate 130 includes a printed circuit board (PCB) with a plurality of LEDs 132 soldered or otherwise coupled to the PCB. The PCB is then coupled to the outer surface 109 of one of the side walls 106*a*-*h* of the housing 102 using screws, adhesives, or other suitable fastening mechanisms.

The central axis A-A extends orthogonally to the direction of light output by the LED units 104*a*, 104*b*, and 104*c*. In addition, the plane in which the fan 120 rotates is parallel to the light output direction, and air flow through the channel 110 is orthogonal to the light output direction.

Figure 4:
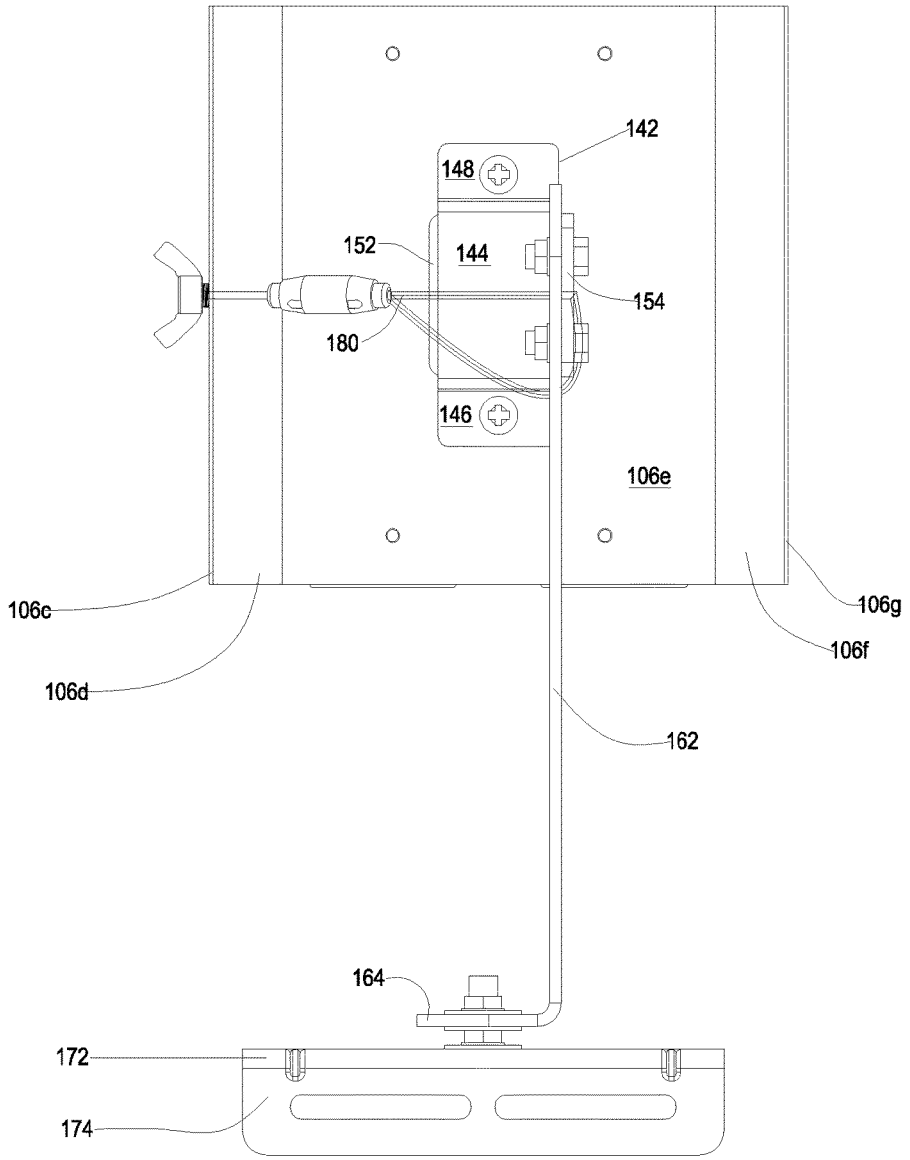
FIG. 4 illustrates a rear view of the LED kit shown in FIG. 1.

The housing 102 may be coupled to a light fixture using a mounting bracket assembly. The mounting bracket assembly 140 includes a base bracket 142 and one or more plates that are coupled between the base bracket 142 and a surface of the light fixture. For example, as shown in the implementation of FIG. 4, the base bracket 142 has a central portion 144 and two side portions 146, 148 on either side of the central portion 144. The central portion 144 is disposed within a separate plane from the side portions 146, 148. The side portions 146, 148 are directly coupled to the outer surface 109 of side wall 106*e*, and the central portion 144 is spaced apart from the outer surface 109 of side wall 106*e*, defining a channel 149. Side wall 106*e* is spaced apart from and opposite side wall 106*a* to which LED unit 104*a* is coupled.

Figure 6:
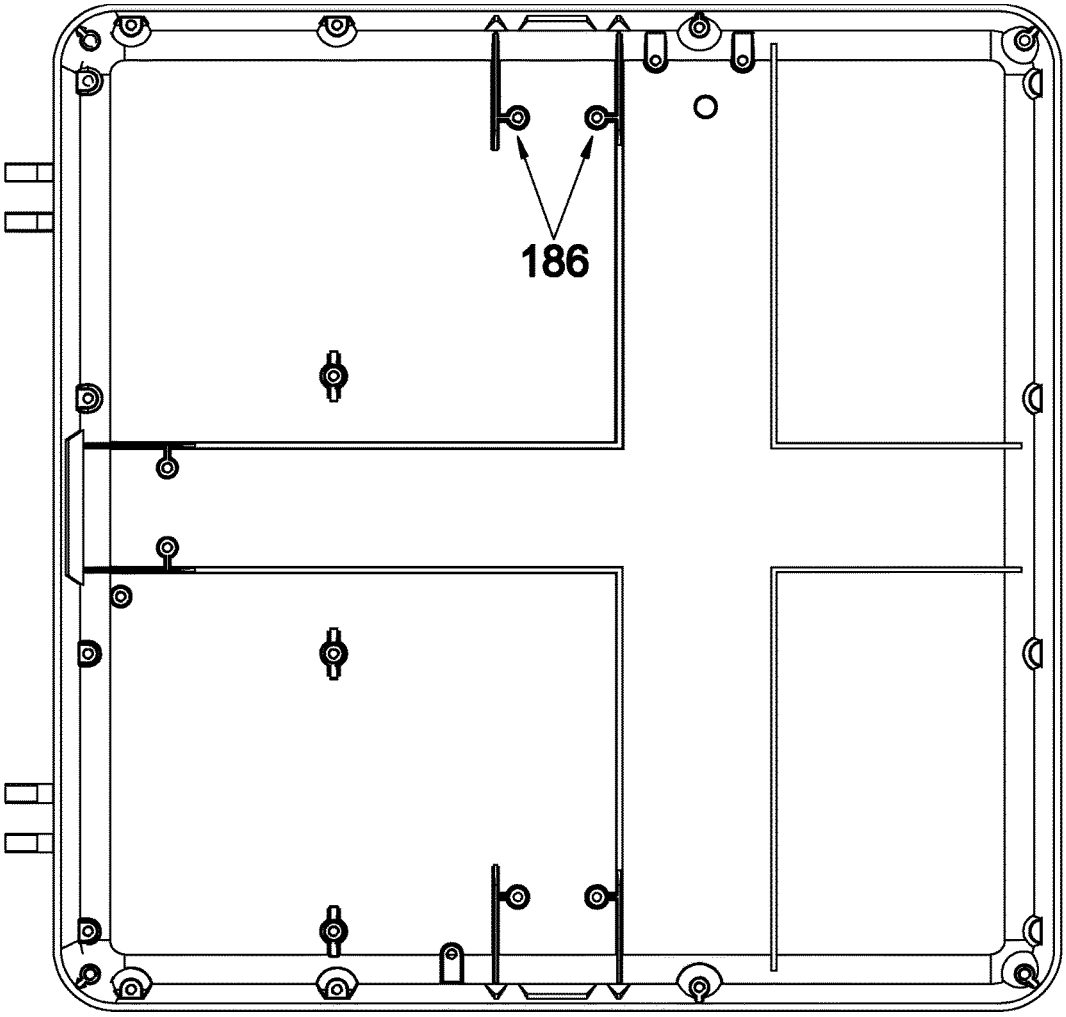
FIG. 6 illustrates an interior surface of a light fixture to which an LED kit may be coupled, according to one implementation.

The mounting bracket assembly 140 further includes a first L-shaped plate 150, a second L-shaped plate 160, and a third L-shaped plate 170. The first L-shaped plate 150 has a first leg 152 and a second leg 154 that is orthogonal to the first leg 152. The first leg 152 is insertable within the channel 149 to hold the first L-shaped plate 150 adjacent the housing 102, and the second leg 154 defines one or more openings 156. The second L-shaped plate 160 includes a first leg 162 and a second leg 164 that is orthogonal to the first leg 162. The first leg 162 defines openings 166 that may be aligned with one or more openings 156 in the first L-shaped plate 150 and engaged with a fastener to couple the first L-shaped plate 150 and the second L-shaped plate 160. And, the second leg 164 defines at least one opening 168. The third L-shaped plate 170 includes a first leg 172 and a second leg 174 that is orthogonal to the first leg 172. The first leg 172 defines openings 176 that may be aligned with the opening 168 in the second leg 164 of the second L-shaped plate 160 and engaged with a fastener to couple the second L-shaped plate 160 and the third L-shaped plate 170. The second leg 174 may define one or more openings 178 through which a fastener is engagable to couple the third L-shaped plate 170 to a light fixture. For example, FIG. 6 illustrates screws 186 on various interior faces of a light fixture that may be engaged into the openings 178 of the second leg 174. The openings 178 may be slot shaped, as shown in FIG. 1, or circular, and the screws 186 engage with the openings 178 to couple the plate 170 with the light fixture.

Figure 5:
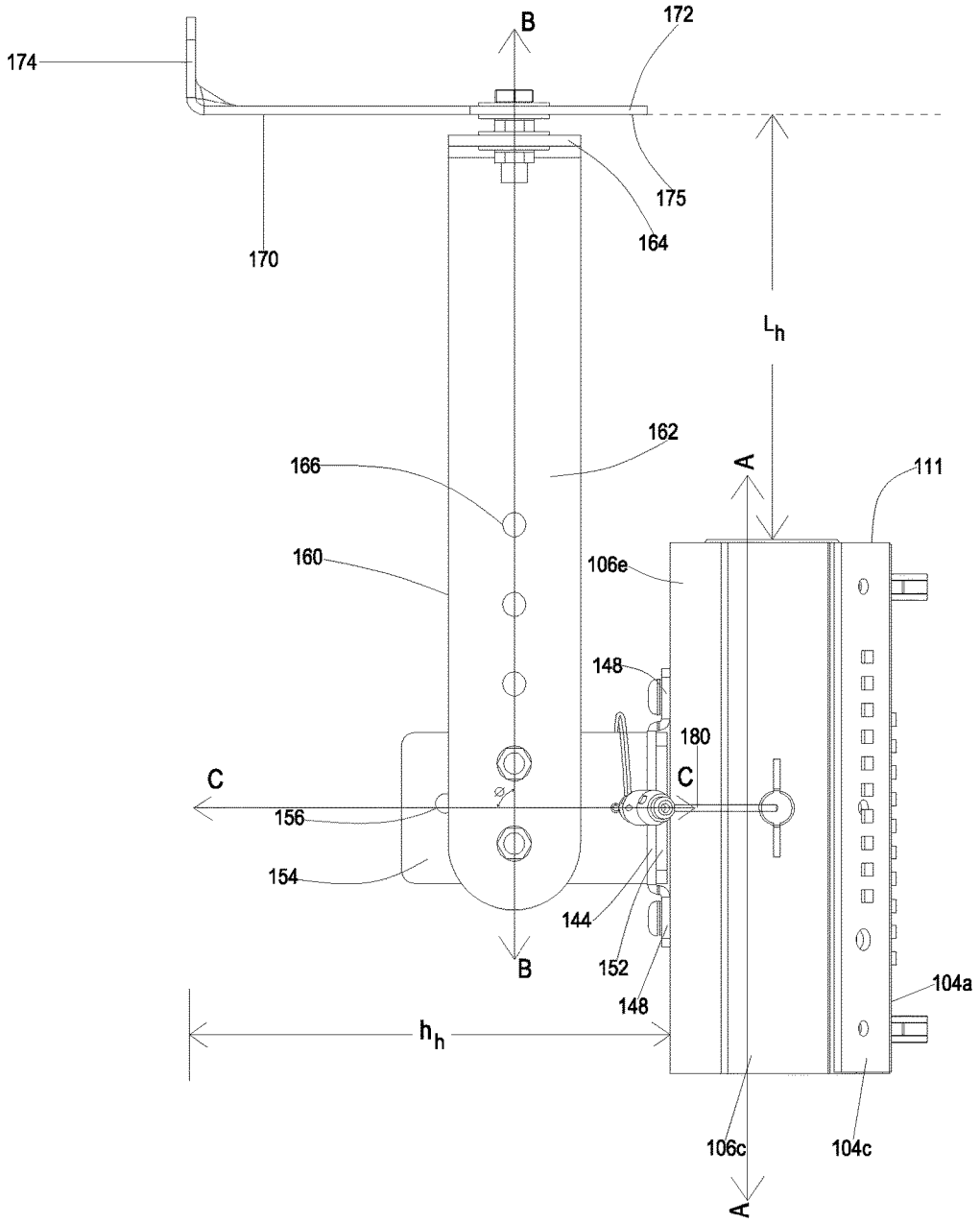
FIG. 5 illustrates a side view of the LED kit shown in FIG. 1.

As shown in FIG. 5, the distance $l_h$ between a proximal end 111 of side wall 106*e* and a proximal surface 175 of leg 172 of the third L-shaped plate 170 is adjustable based on the openings 166 selected for engaging with a fastener to couple the second plate 160 with the first plate 150. Furthermore, the distance $h_h$ between the second leg 174 of the third plate 170 and a plane in which the outer surface 109 of side wall 106*e* lies is adjustable based on the opening 176 selected for engaging with a fastener to couple the second plate 160 and the third plate 170. In addition, an angle $\theta_h$ between central axis B-B of the second plate 160 and central axis C-C of the first plate 150 is also adjustable based on the openings 156 selected for engaging with fasteners to couple the second plate 160 and the first plate 150. As shown in FIG. 5, the angle $\theta_h$ is 90°, but this angle may be adjusted to an angle between 0° and 90°.

Figure 2:
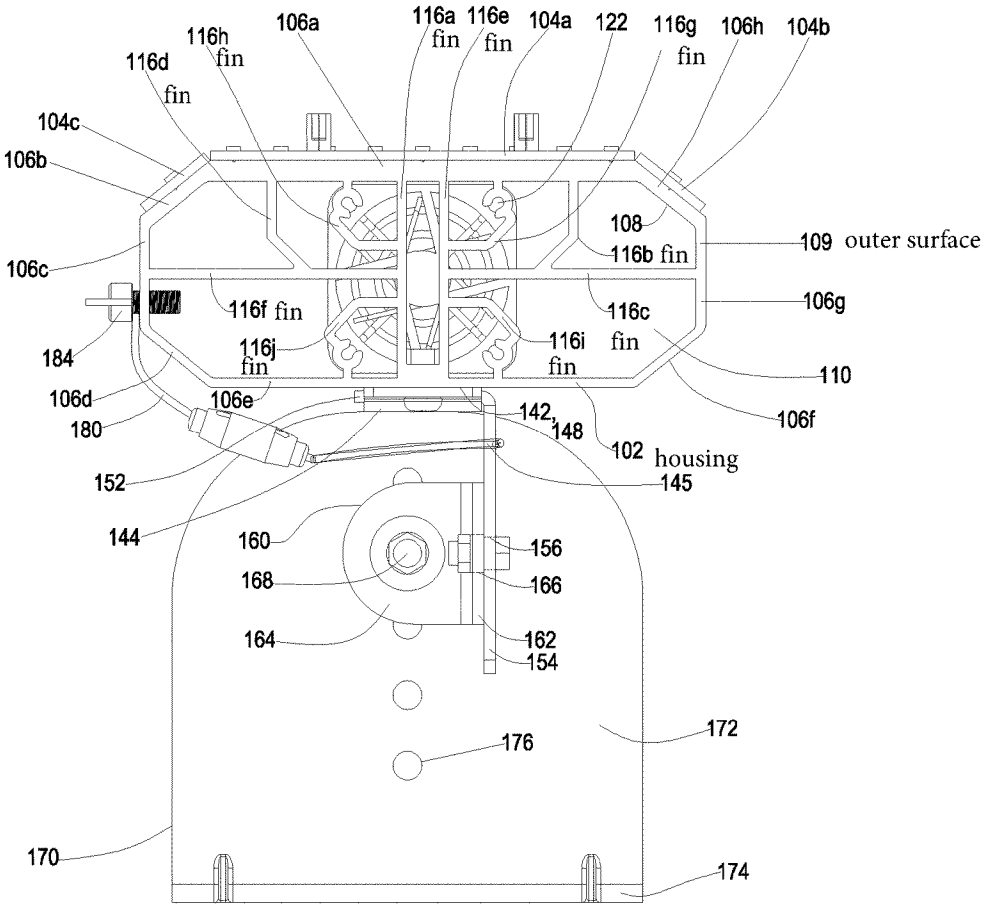
FIG. 2 illustrates a first end view of the LED kit in FIG. 1.
Figure 3:
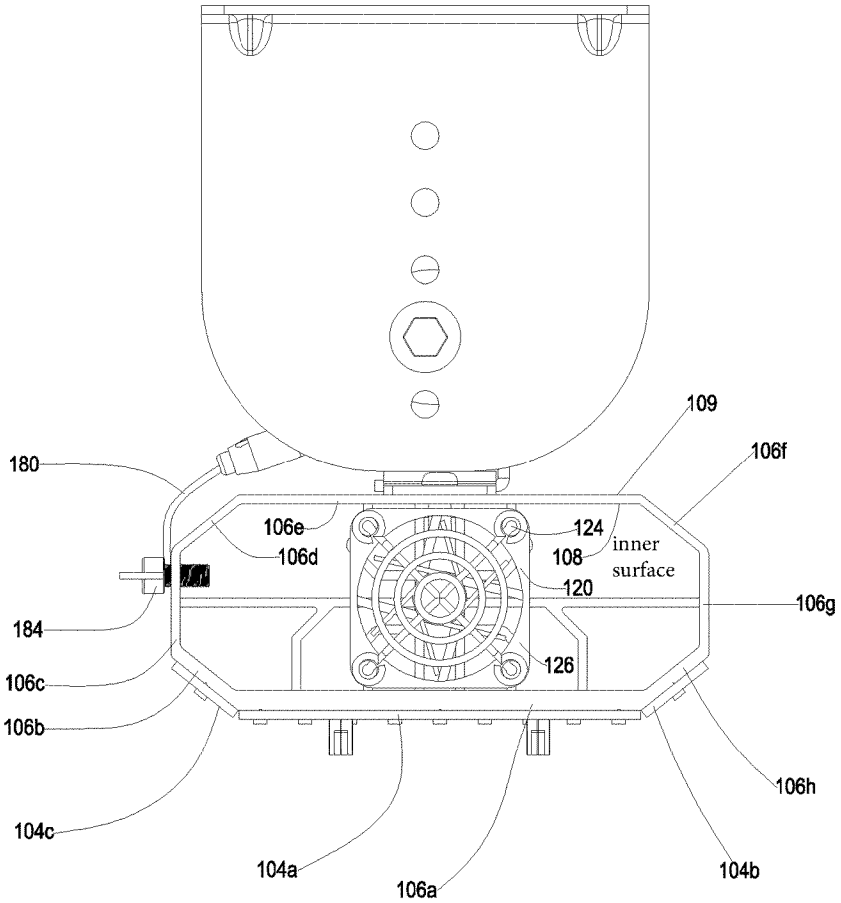
FIG. 3 illustrates a second end view of the LED kit shown in in FIG. 1.

To prevent the first L-shaped bracket 150 from sliding away from the base bracket 142, a cord 180 may be coupled between the first L-shaped bracket 150 and the housing 102. In particular, as shown in FIG. 2, the cord 180 extends from an opening 145 defined in the second leg 154 of the first L-shaped plate 150 and a screw 184 extending from the outer surface 109 of side wall 106*c* of the housing 102. As shown in FIG. 2, the first leg 152 of the first L-shaped plate 150 slides between the central portion 144 of the base bracket 142 and side wall 106*e* in a direction from side wall 106*g* toward 106*c*. The second leg 154 of the plate 150 extends away from side wall 106*e*. Thus, once the cord 180 is secured by the screw 184, the first leg 152 cannot be moved away from the base bracket 142. In other implementations, the screw 184 may be included on another side wall, such as side walls 106*d* or 106*b*, or it may be included on side walls 106*f*, 106*g*, or 106*h* if the first leg 152 is slid between the base bracket 142 and side wall 106*e* from the opposite direction. The cord 180 may be made from a metal material, for example.

In other implementations, the base bracket 142 may be coupled to another side wall of the housing 102 or one of the plates may be directly coupled to one of the side walls of the housing 102.

Figure 7:
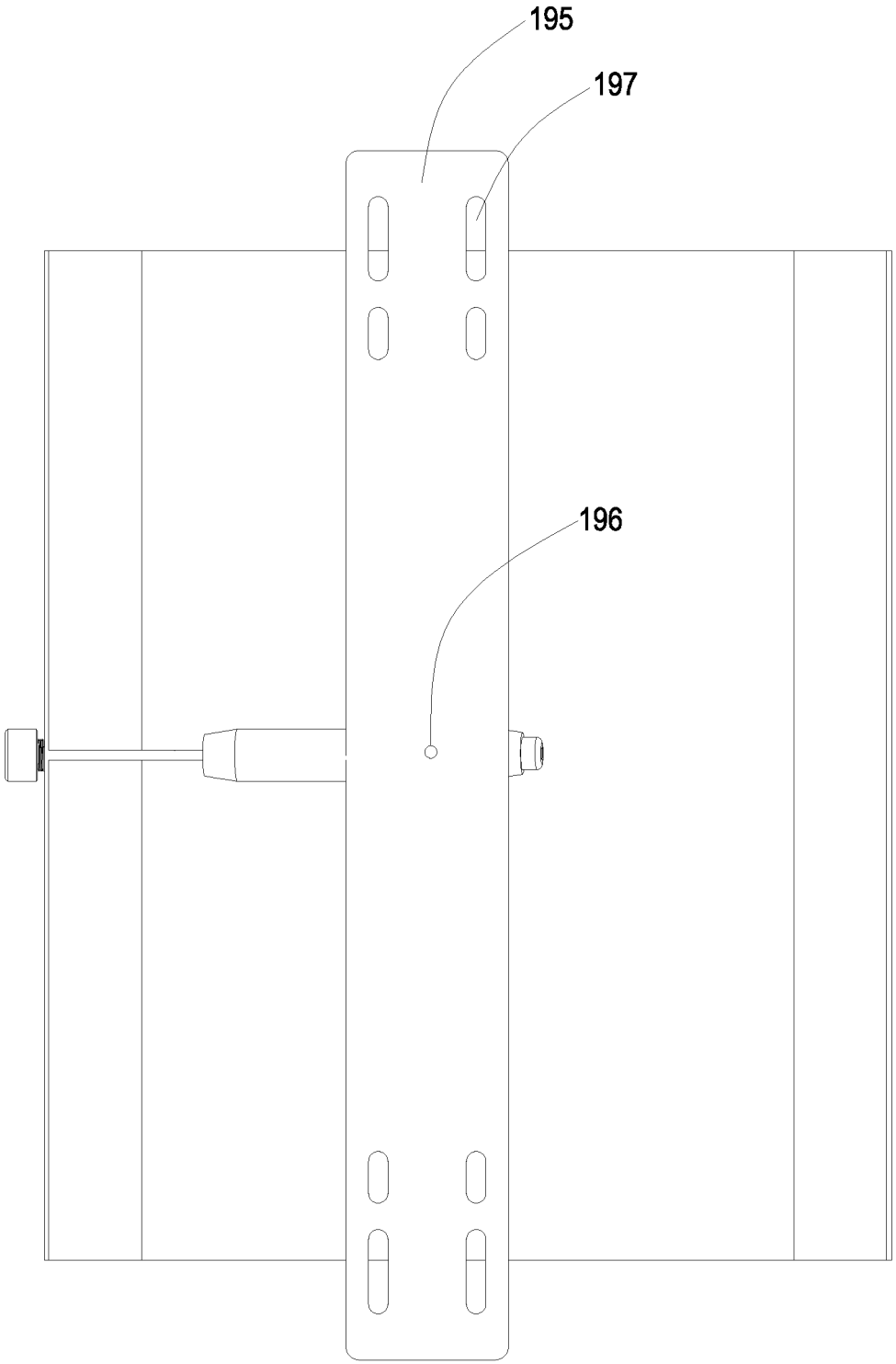
FIG. 7 illustrates a rear view of the LED kit shown in FIG. 1 with a flat plate bracket.

In the implementation shown in FIGS. 1-5, the housing 102 is mounted in a horizontal arrangement in that the first leg 162 of the second L-shaped plate 160 extends from the second leg 154 of the first L-shaped plate 150 at an angle greater than 0° (e.g., 90°). However, in other implementations, such as shown in FIG. 7, the housing 102 may be secured to the light fixture in a vertical arrangement. In the vertical arrangement, the first leg 162 of the second L-shaped plate 160 is the coupled to the second leg 154 of the first L-shaped plate 150 such that axis B-B of plate 160 and axis C-C of plate 150 are at an angle of 0° relative to each other. A flat plate 195, which defines openings 196 and 197, is coupled to the second plate 160 by engaging a screw or other fastener through aligned openings 168, 196 of the plate 160 and plate 195, respectively. The flat plate 195 is coupled to the light fixture by inserting a screw or other fastener through one or more of the other openings 197.

Figure 8:
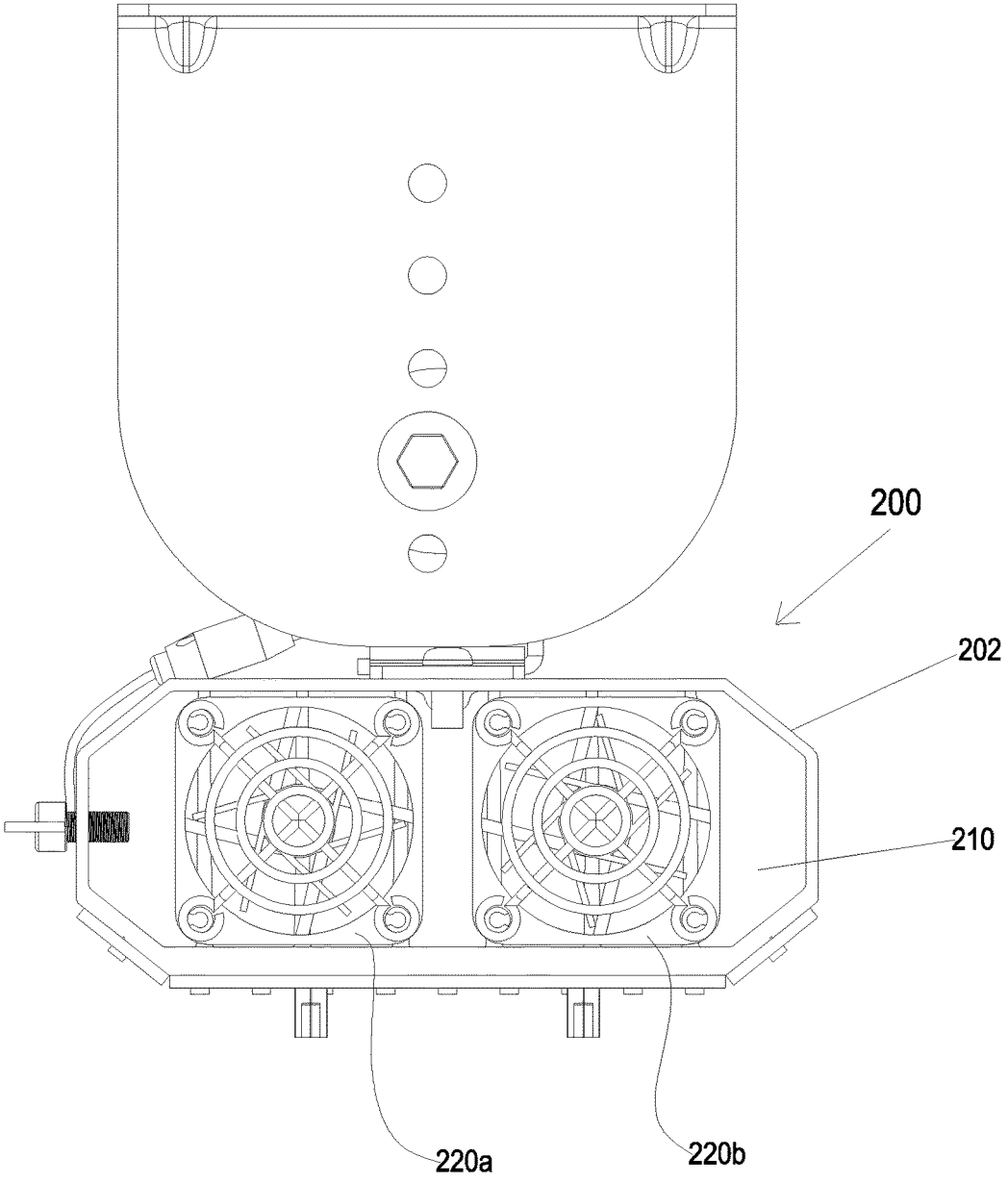
FIG. 8 illustrates a first end view of an LED kit having two fans, according to one implementation.
Figure 9:
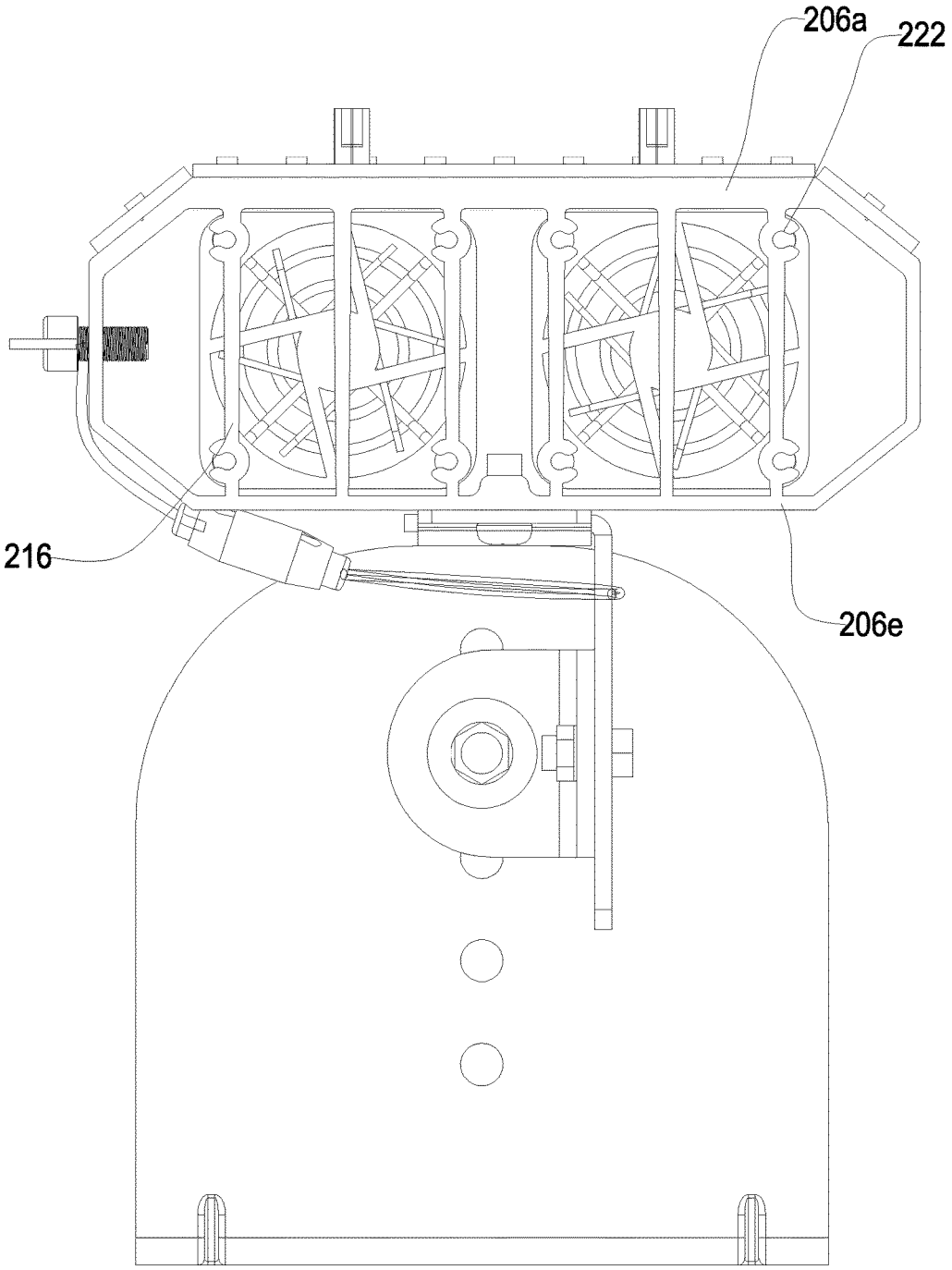
FIG. 9 illustrates a second end view of the LED kit shown in FIG. 9.
Figure 10:
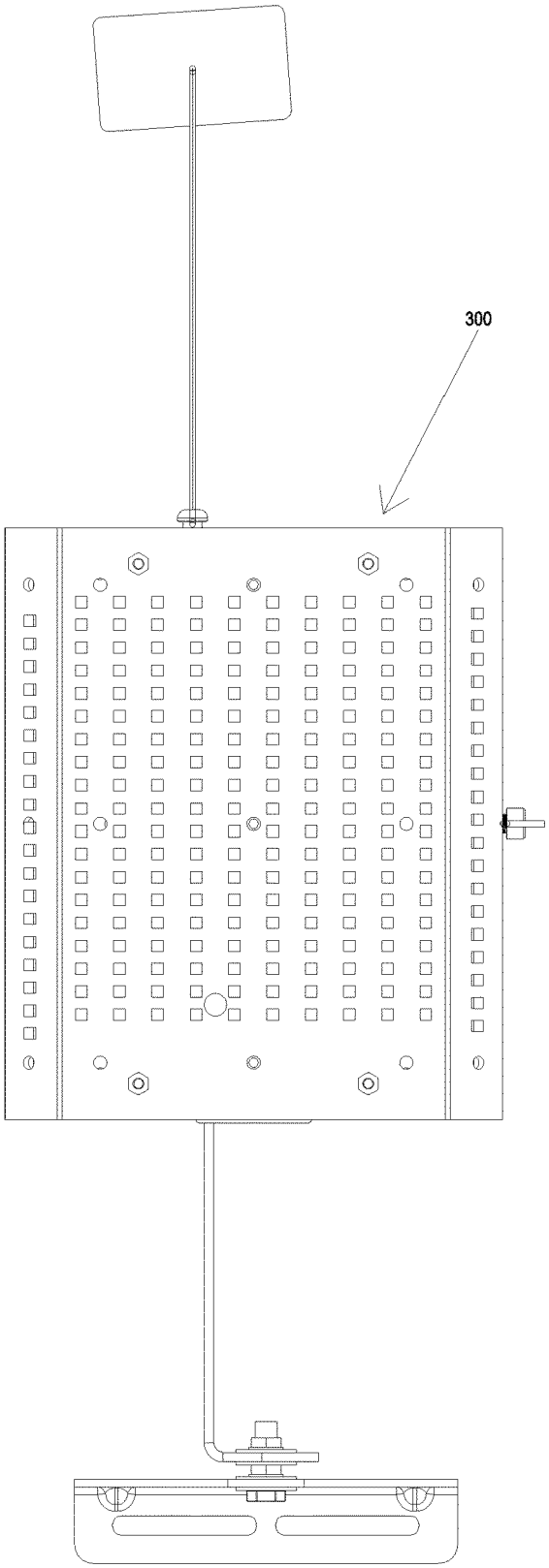
FIG. 10 illustrates a front view of an LED kit according to one implementation.
Figure 11:
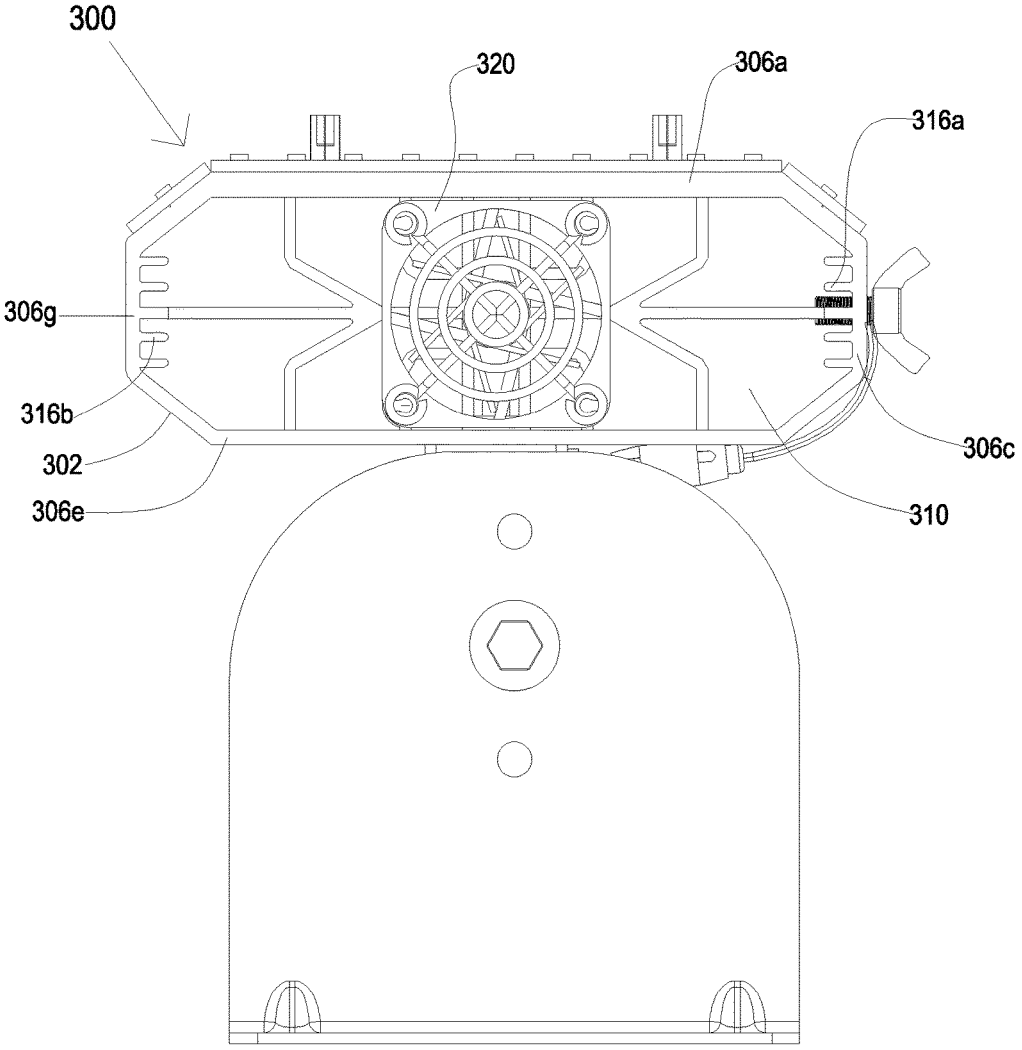
FIG. 11 illustrates a first end view of the LED kit shown in FIG. 10.

FIGS. 1-5 illustrate an implementation of the LED kit 100 that includes one fan 120 disposed at one end of the channel 110 defined by the housing 102. However, in other implementations, the housing may include two or more fans, and the two or more fans may be disposed at the same end of the channel or at different ends of the channel. For example, as shown in FIGS. 8 and 9, the LED kit 200 includes a housing 202 that includes two fans 220*a*, 220*b* disposed at one end of the channel 210 of the housing 202. In addition, each fin 216 extends between side wall 206*a* and 206*e*, which are spaced apart from and opposite each other and along the length of the channel 210 in the direction of the central axis extending through the channel 210. The fins 216 define bosses 222 that may receive screws or other fasteners for coupling the fans 220*a*, 220*b* to the housing 202.

FIGS. 1-5 and 8-9 illustrate LED kits 100, 200 that include LED units that consume between about 30 Watts and about 60 Watts. However, other LED kits may consume more power than this. Increasing the consumption of power results in increased heat generation. For example, FIGS. 10-17 illustrate implementations of LED kits 300, 300', 300" that consume between 75 Watts and about 120 Watts.

The LED kit 300 shown in FIGS. 10-13 includes one fan 320 that is coupled to one end of the housing 302. The fin arrangement includes fourteen fins that are arranged differently than the fin arrangements shown in FIGS. 1-5. In particular, the fins include a plurality of fins 316*a*, 316*b* that extend from side walls 306*c* and 306*g*, respectively, into the channel 310, fins 316*c* and 316*d* that extend between side walls 306*a* and 306*e* and are spaced apart from each other and are adjacent the central axis of the channel 310, fin 316*e* that extends between side wall 306*a* and fin 316*c*, fin 316*f* that extends between side wall 306*a* and fin 316*d*, fin 316*g* that extends between side wall 306*g* and fin 316*c*, fin 316*h* that extends between side wall 306*c* and fin 316*d*, fin 316*i* that extends between side wall 306*a* and fin 316*g*, fin 316*j* that extends between side wall 306*a* and fin 316*h*, fin 316*k* that extends between side wall 306*e* and fin 316*d*, fin 316*l* that extends between side wall 306*e* and fin 316*c*, fin 316*m* that extends between side wall 306*e* and fin 316*g*, and fin 316*n* that extends between side wall 306*e* and fin 316*h*. Fins 316*e*, 316*f*, 316*k*, and 316*l* define bosses 322 that may be aligned with openings in the fan 320 to couple the fan 320 to the housing 302 using screws or other fasteners.

This implementation also includes a second cord 190 that extends from the housing 302 to the light fixture. The second cord 190 may be secured to the housing 302 and a surface of the light fixture via screws or other suitable fastening mechanism. In the implementation shown in FIGS. 10-13, the second L-shaped plate 160 extends away from end 311 of the housing 302, and the cord 190 extends away from end 312 of the housing 302. However, in other implementations, the cord 190 may extend vertically from side wall 306*e*, for example. The cord 190 may be a metal material, for example.

Figure 12:
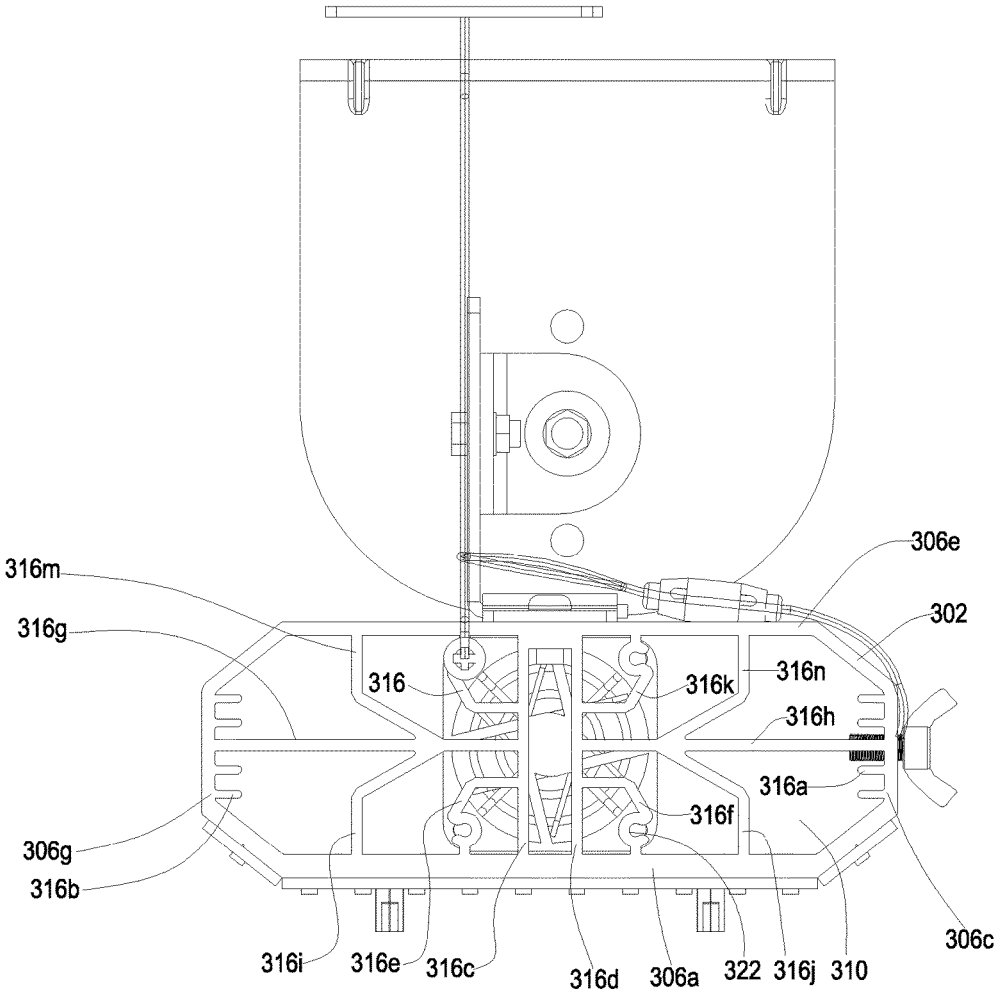
FIG. 12 illustrates a second end view of the LED kit shown in FIG. 10.
Figure 13:
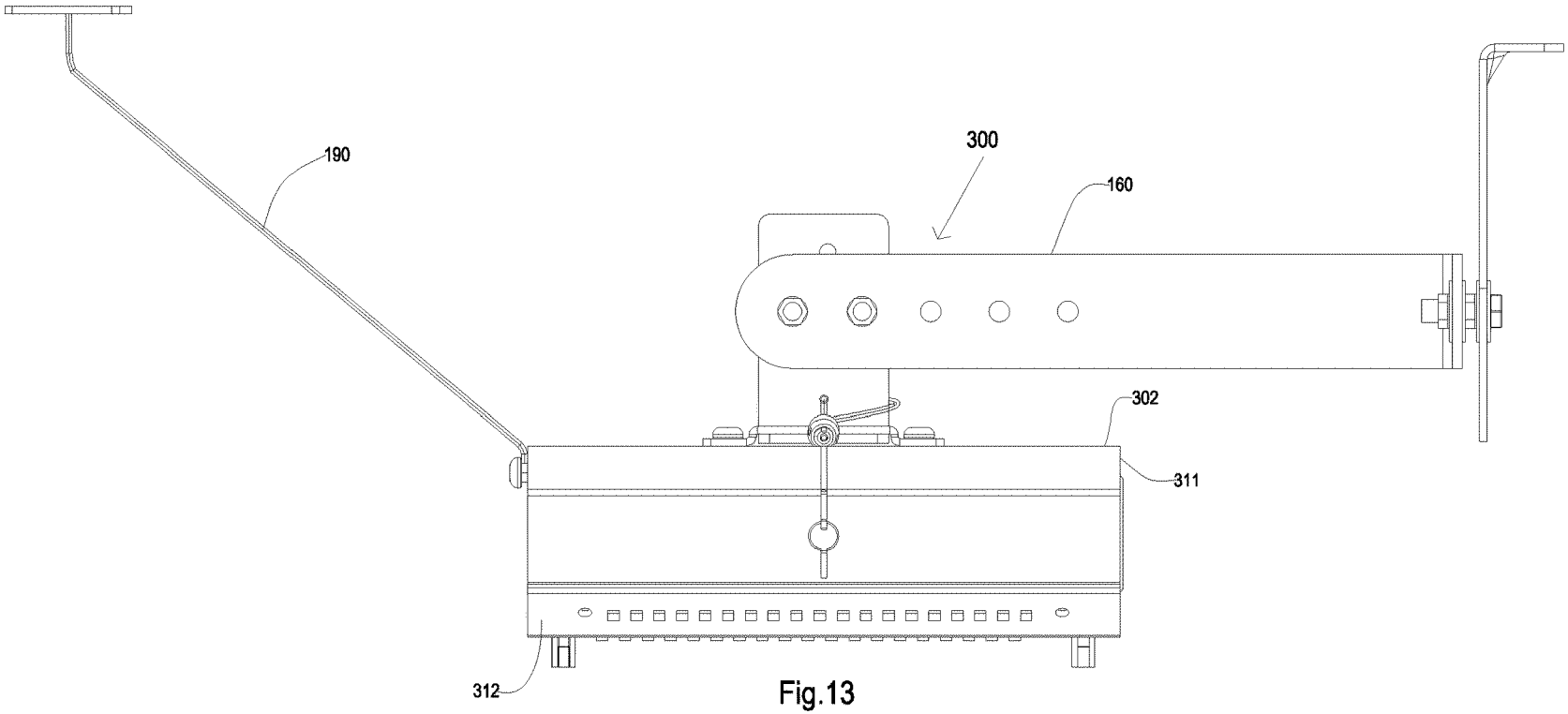
FIG. 13 illustrates a side view of the LED kit shown in FIG. 10.
Figure 14:
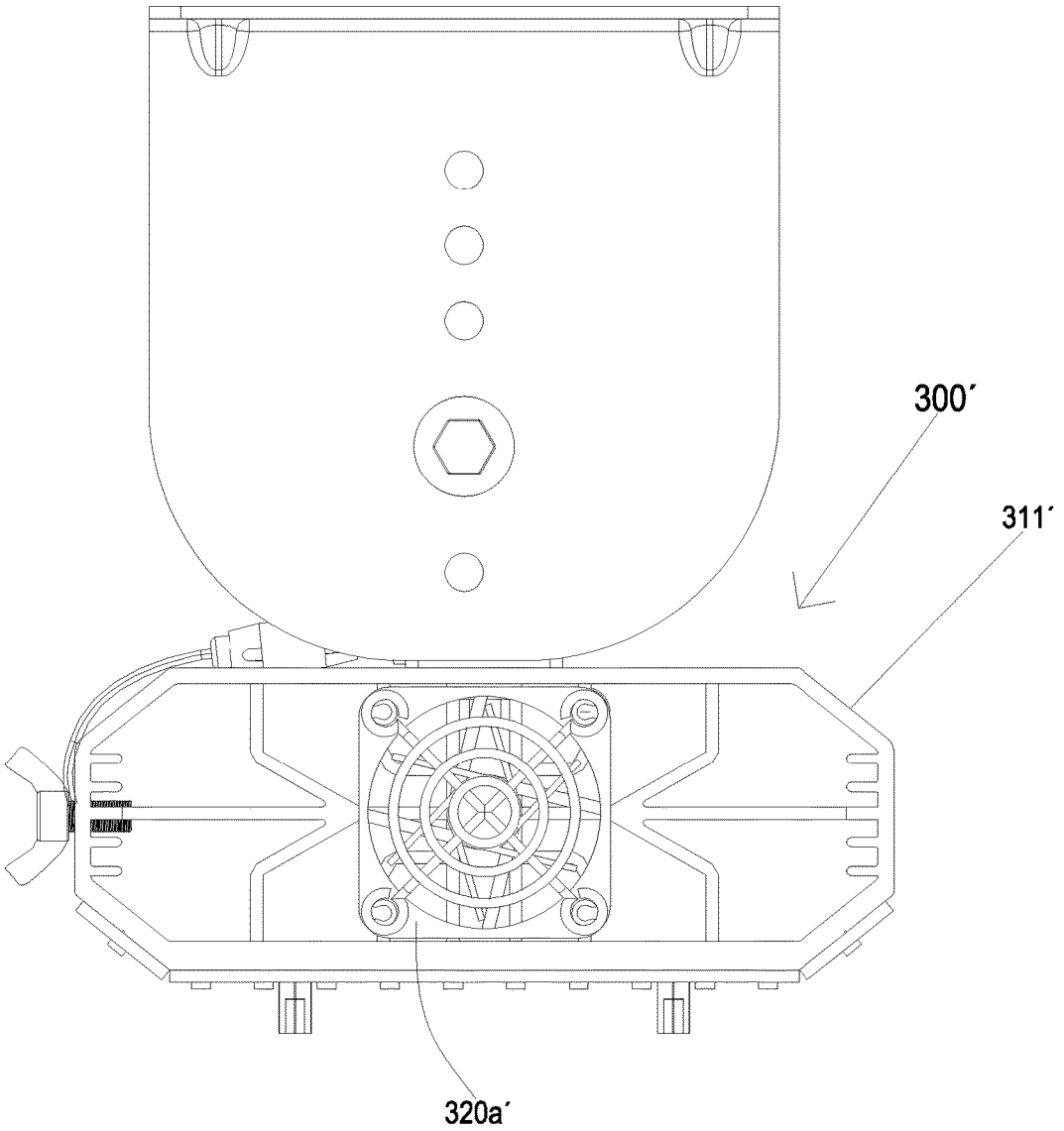
FIG. 14 illustrates a first end view of an LED kit according to one implementation.
Figure 15:
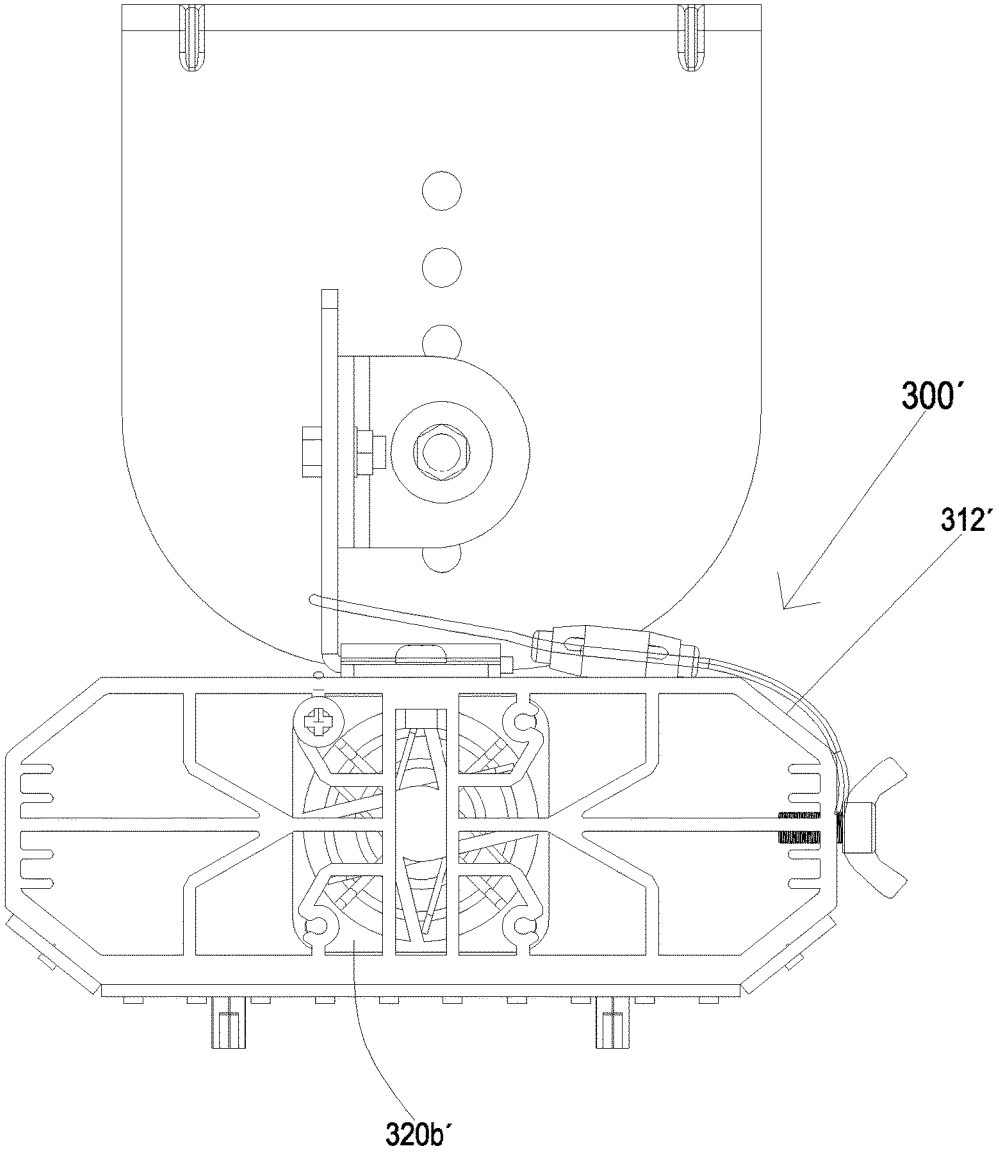
FIG. 15 illustrates a second end view of the LED kit shown in FIG. 14.

FIGS. 14 and 15 illustrate an implementation of an LED kit 300' that includes two fans 320*a*', 320*b*'. Fan 320*a*' is disposed adjacent proximal end 311', and fan 320*b*' is disposed adjacent distal end 312'. The fin arrangement in FIGS. 14 and 15 is the same as is shown in FIG. 12.

Figure 16:
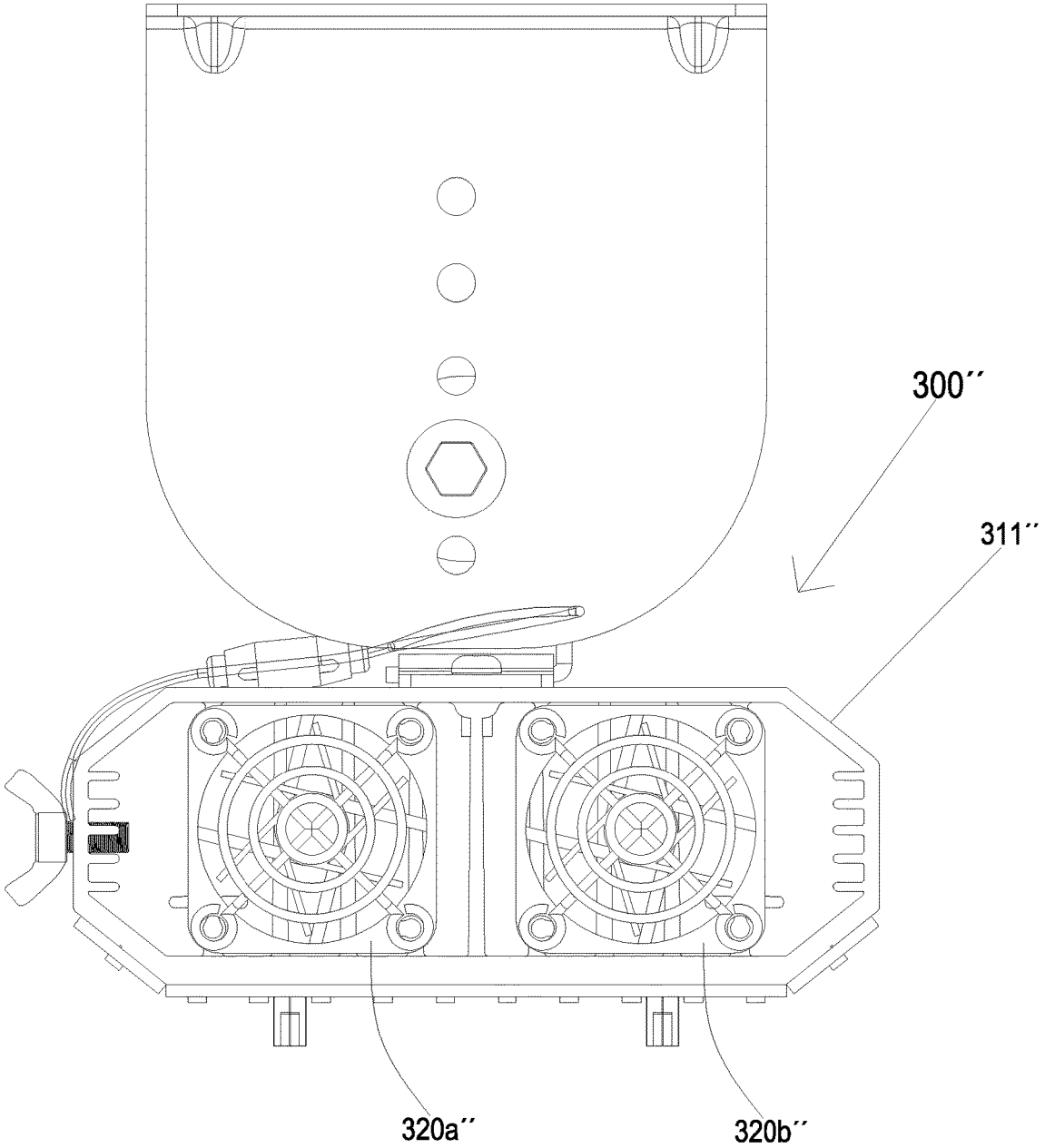
FIG. 16 illustrates a first end view of an LED kit according to one implementation.
Figure 17:
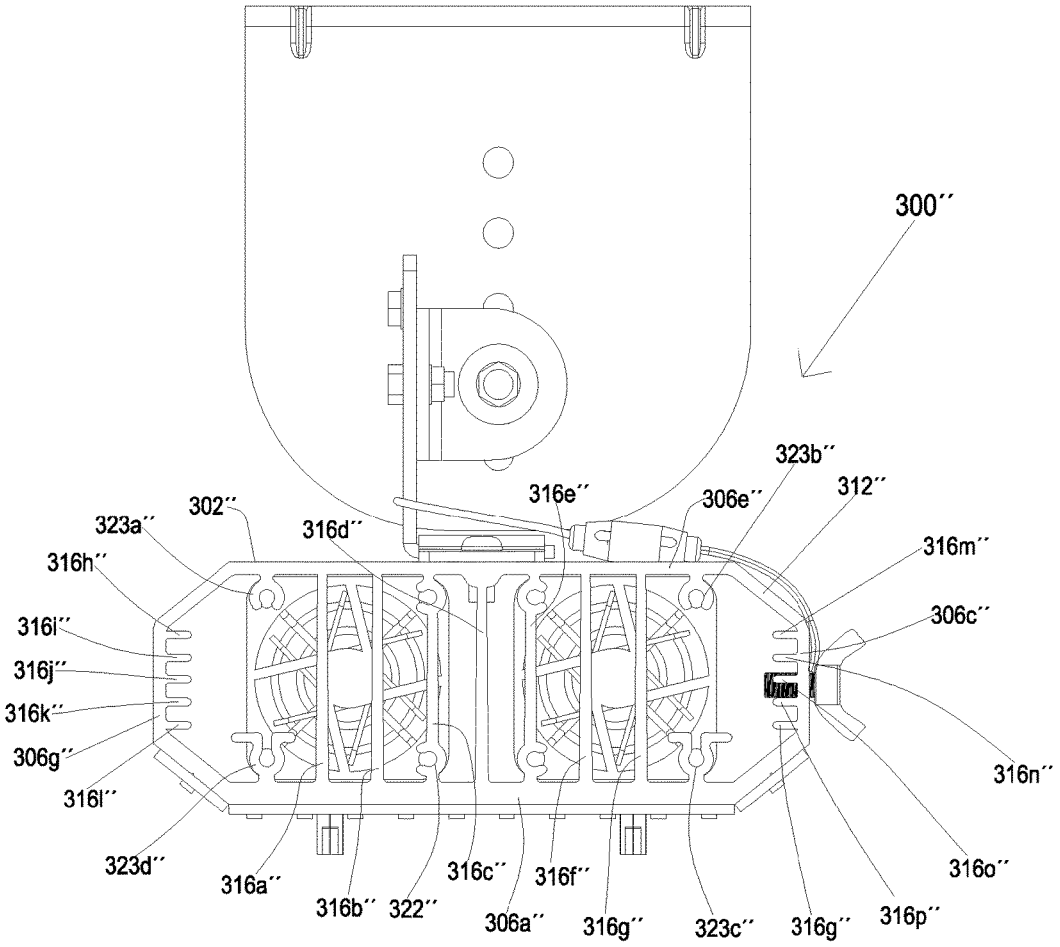
FIG. 17 illustrates a second end view of the LED kit shown in FIG. 16.

The LED kit 320" shown in FIGS. 16 and 17 includes two fans 320*a*", 320*b*" coupled to the proximal end 311" of the housing 302". The housing 302" includes seven fins 316*a*"-316*g*" that extend between side walls 306*a*" and 306*e*", five fins 316*h*"-316*l*" that extend from side wall 306*g*, five fins 316*m*"-316*q*" that extend from side wall 306*c*. Fins 316*c*" and 316*e*" define bosses 322" for receiving screws or other fasteners for coupling the fans 320*a*", 320*b*" to the housing 302". The housing 302" also includes additional bosses 323*a*"-323*d*" for receiving screws or other fasteners for coupling the fans 320*a*", 320*b*" to the housing 302".

FIGS. 18-24 illustrate implementations of LED kits 600, 600', 700 that consume between 150 Watts and about 200 Watts.

Figure 18:
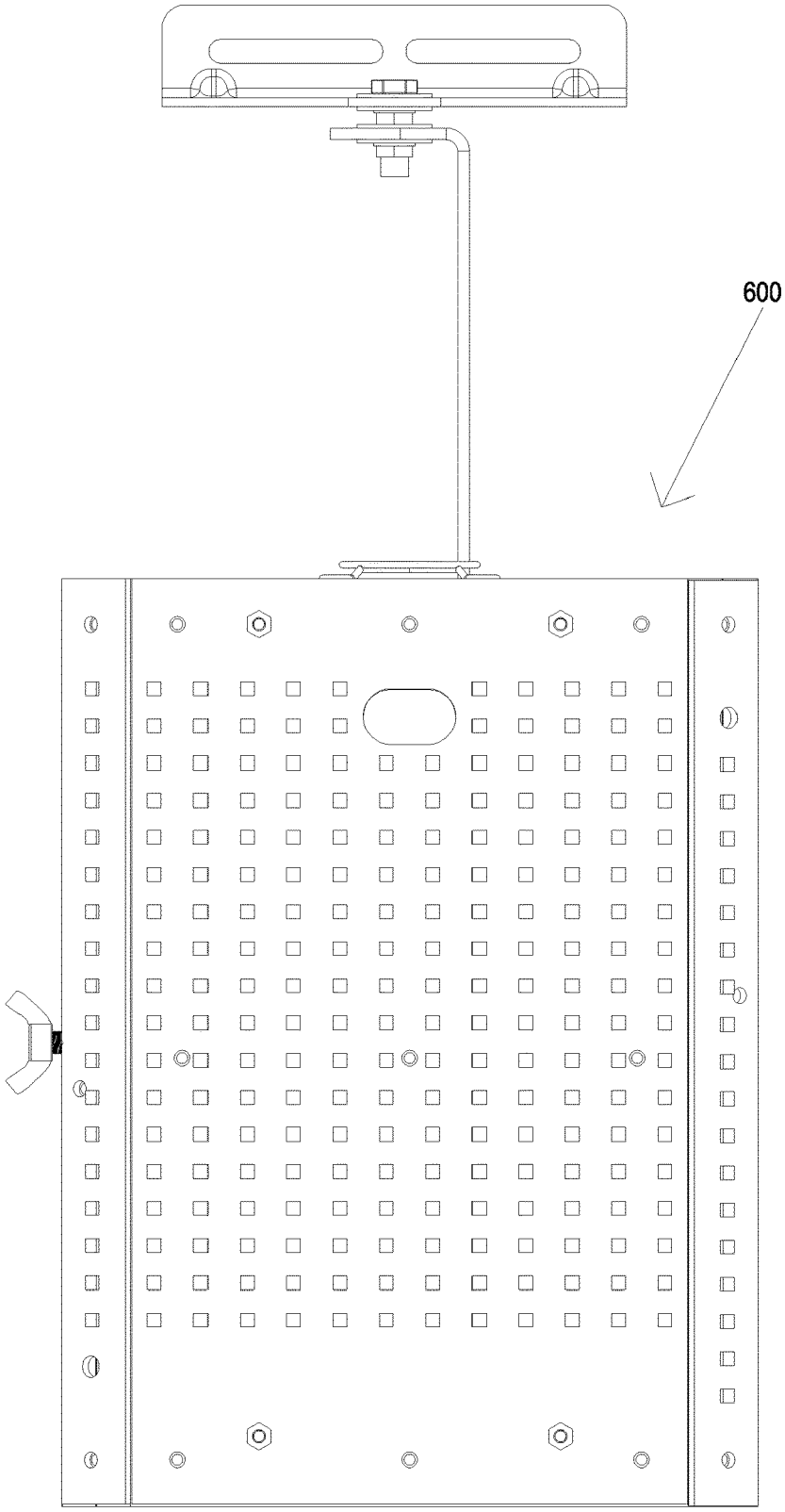
FIG. 18 illustrates a front view of an LED kit according to another implementation.
Figure 19:
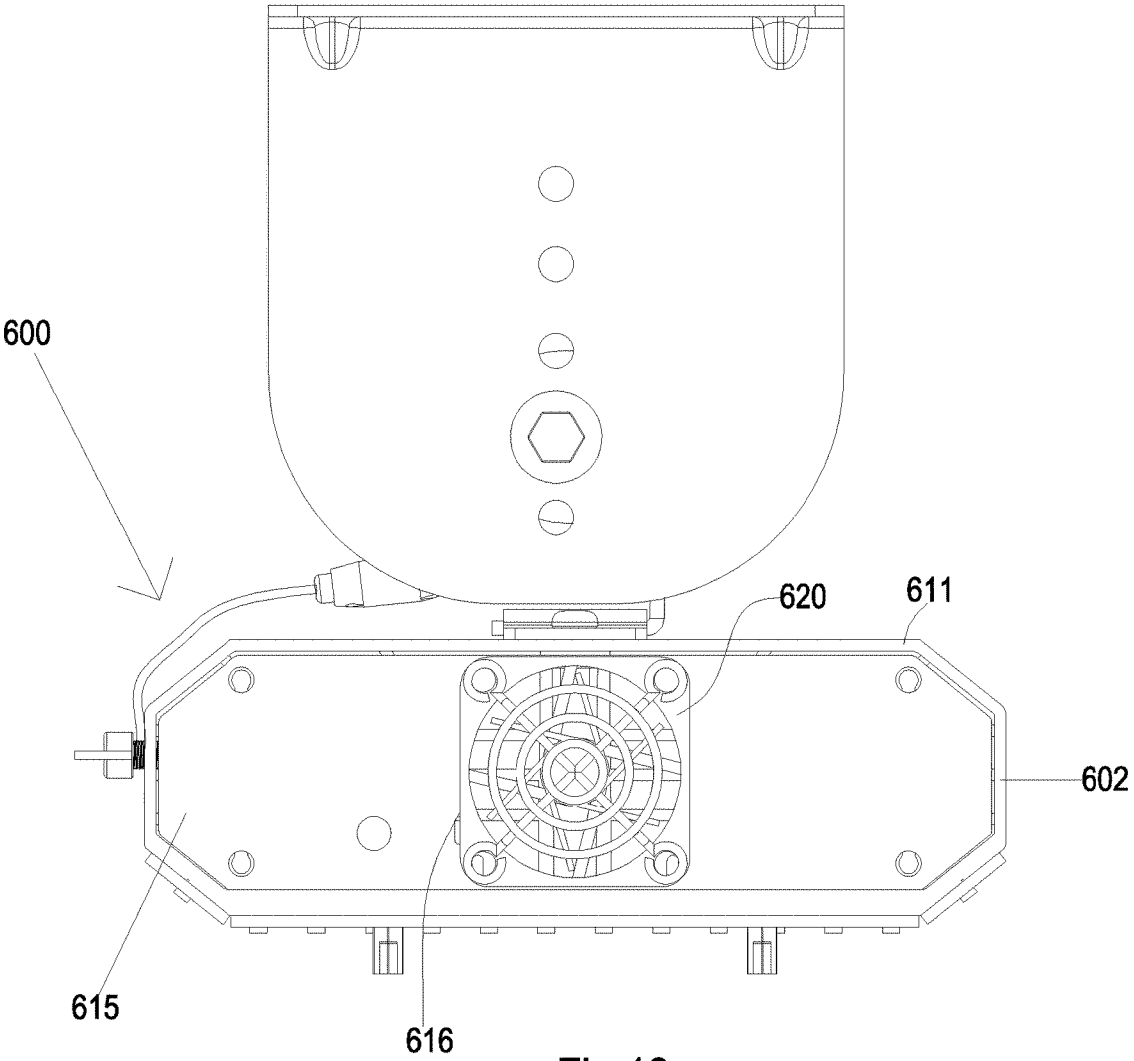
FIG. 19 illustrates a first end view of the LED kit shown in FIG. 18.
Figure 20:
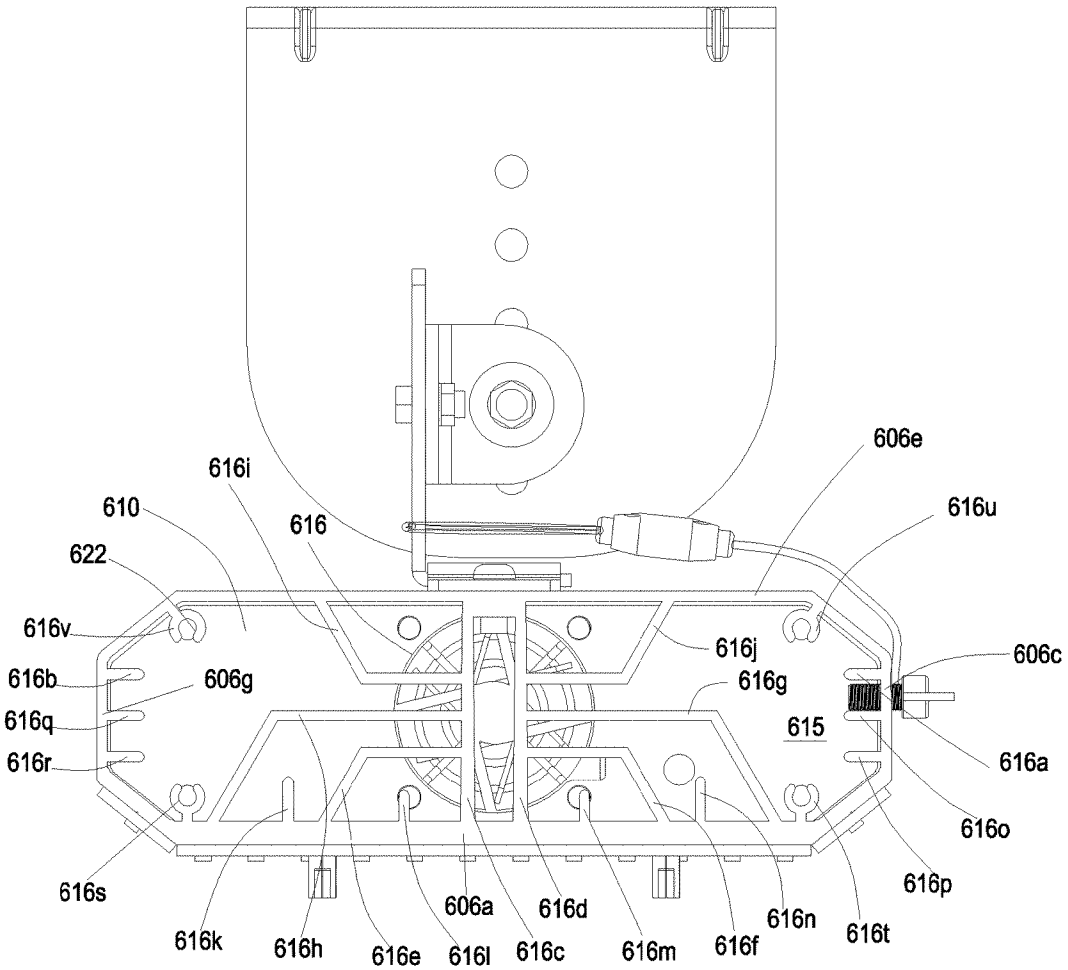
FIG. 20 illustrates a second end view of the LED kit shown in FIG. 18.

The LED kit 600 shown in FIGS. 18-20 includes one fan 620 that is coupled adjacent to the proximal end 611 of the housing 602. A plate 615 is disposed between the fan 620 and fins, which are discussed below. The plate 615 defines an opening 616, and fan 620 is disposed adjacent the opening 616. Air is pulled through the opening 616 by the fan 620. The fin arrangement includes twenty two fins that are arranged differently than the fin arrangements shown in the previously described figures. In particular, the fins include three fins 616*a*, 616*o*, 616*p* that extend from side wall 606*c* into channel 610, three fins 616*b*, 616*q*, and 616*r* that extend from side wall 606*g* into the channel 610, fins 616*c* and 616*d* that extend between side walls 606*a* and 606*e* and are spaced apart from each other and are adjacent the central axis of the channel 610, fin 616*e* that extends between side wall 606*a* and fin 616*c*, fin 616*f* that extends between side wall 606*a* and fin 616*d*, fin 616*g* that extends between side wall 606*a* and fin 616*d*, fin 616*h* that extends between side wall 606*a* and fin 616*c*, fin 616*i* that extends between side wall 606*e* and fin 616*c*, fin 616*j* that extends between side wall 606*e* and fin 616*d*, and fins 616*k*-616*n* that extend from side wall 606*a*. In addition, fins 616*s* and 616*t* extend from side wall 606*a*, and fins 616*u* and 616*v* extend from side walls 606*e*. Fins 616*s*-616*v* define bosses 622.

Figure 21:
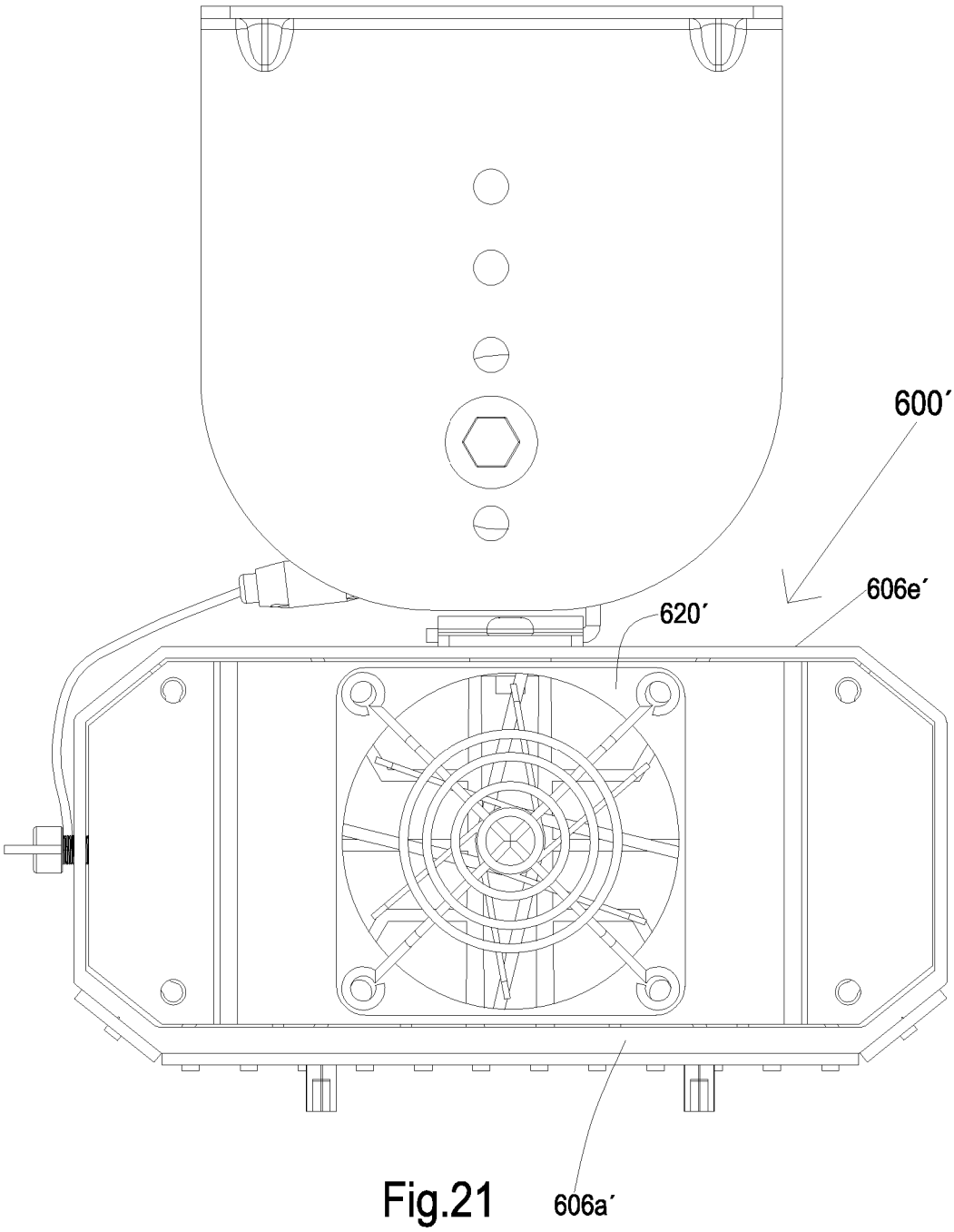
FIG. 21 illustrates a first end view of an LED kit according to one implementation.
Figure 22:
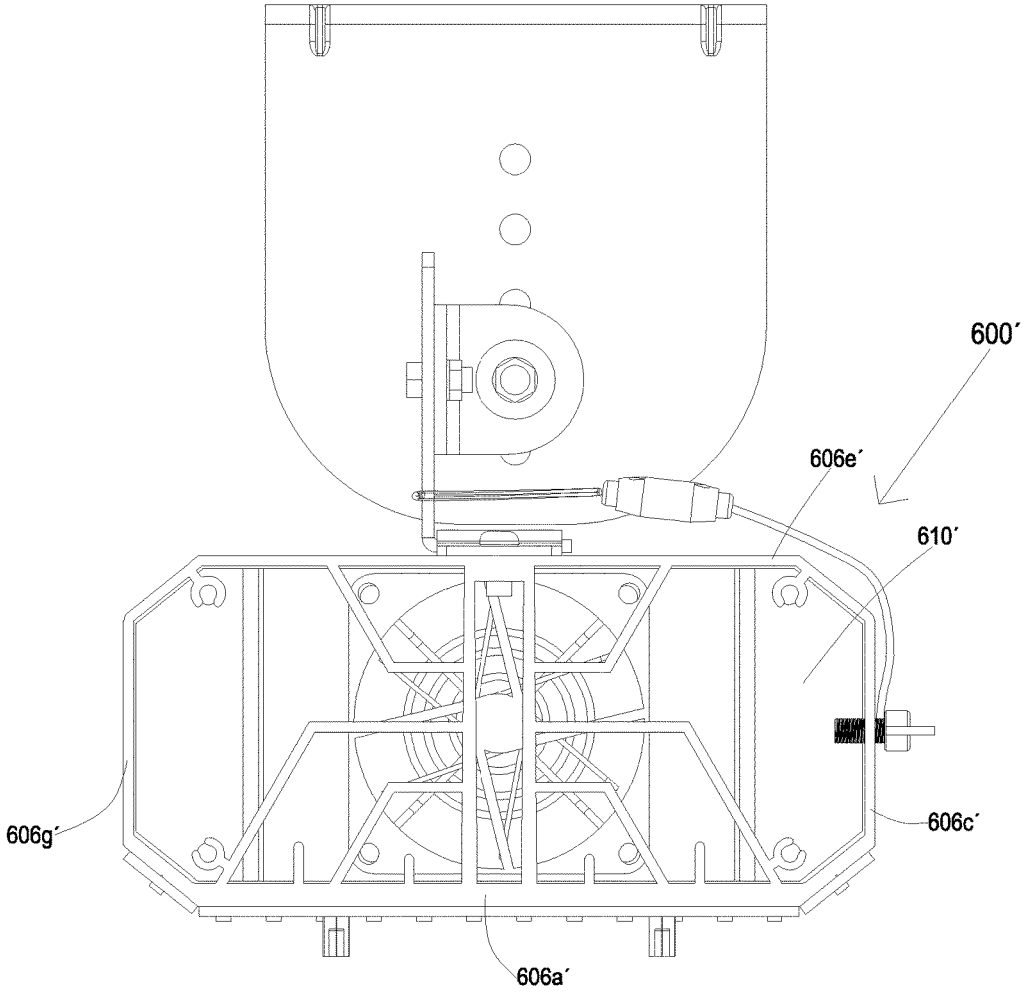
FIG. 22 illustrates a second end view of the LED kit shown in FIG. 21.

In the implementation shown in FIGS. 21 and 22, the distance between side walls 606*a*' and 606*e*' is wider than the distance between side walls 606*a*, 606*e* shown in FIGS. 18-20. In addition, side walls 606*c*' and 606*g*' do not include fins extending into the channel 610'.

Figure 23:
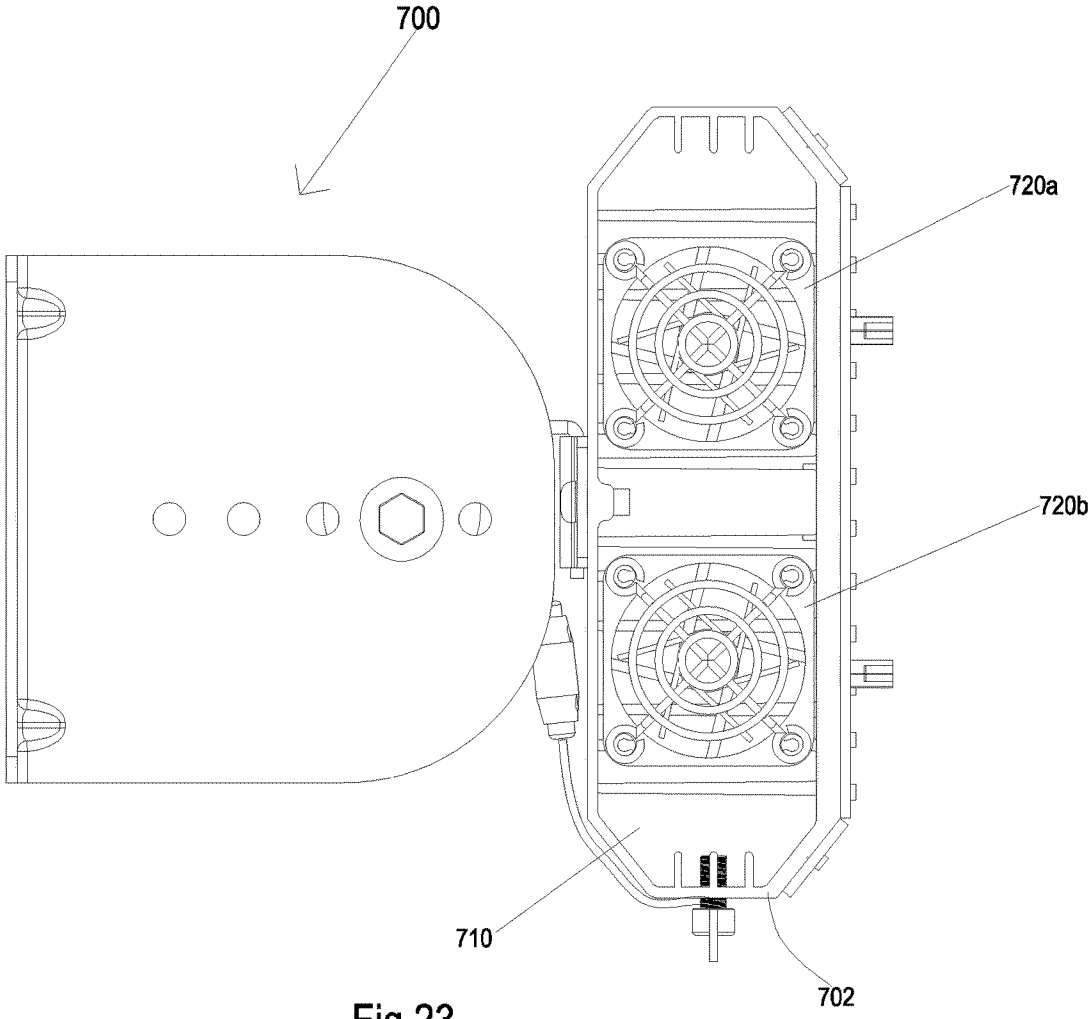
FIG. 23 illustrates a first end view of an LED kit according to one implementation.
Figure 24:
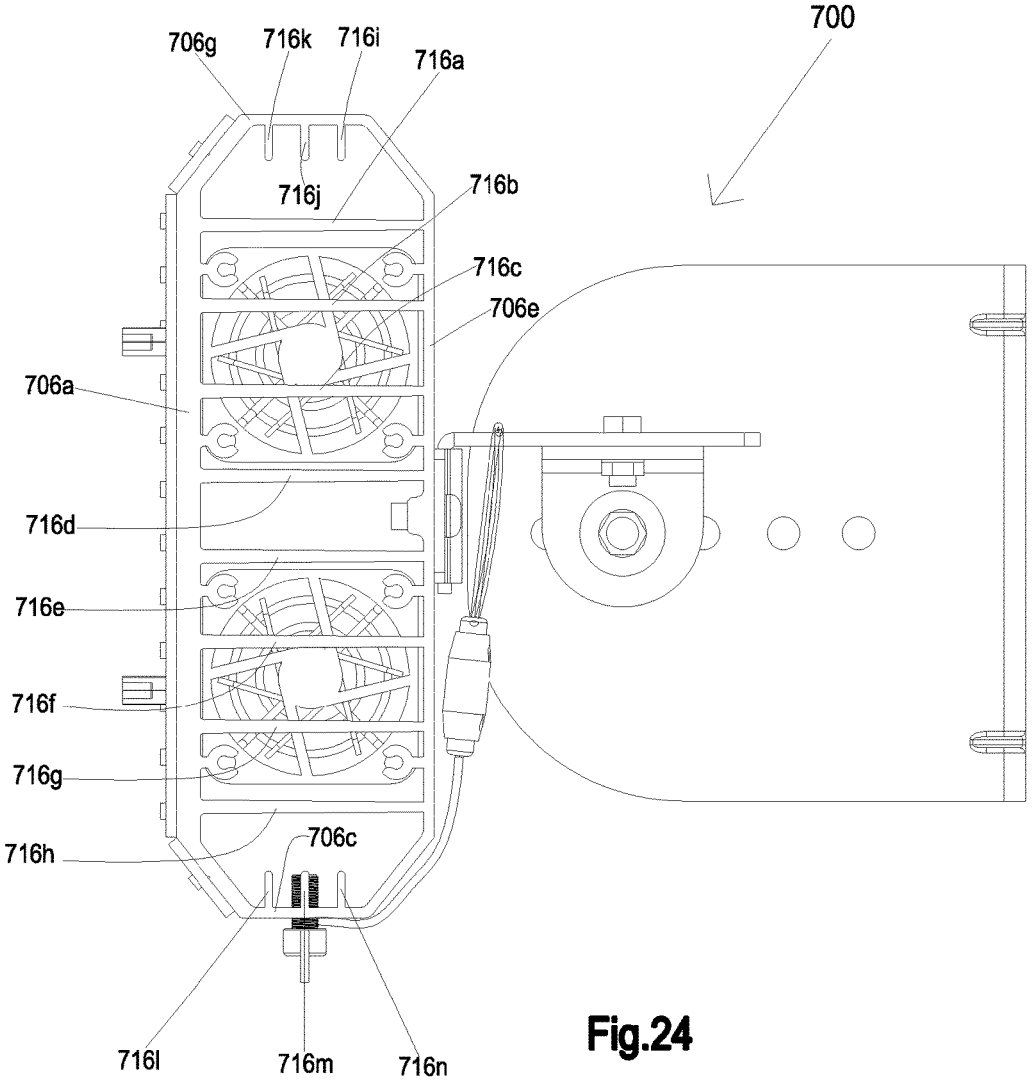
FIG. 24 illustrates a second end view of the LED kit shown in FIG. 23.

The LED kit 700 shown in FIGS. 23 and 24 include two fans 720*a* and 720*b* that are disposed on one end of the channel 710 of the housing 702. In addition, the housing 702 includes eight fins 716*a*-716*h* that extend between side wall 706*a* and 706*e*, three fins 716*i*-716*k* that extend from side wall 716*g*, and three fins 716*l*-716*n* that extend from side wall 706*c*.

FIGS. 25-32 illustrate implementations of LED kits 500, 800, 900 that consume between 280 Watts and about 350 Watts.

Figure 25:
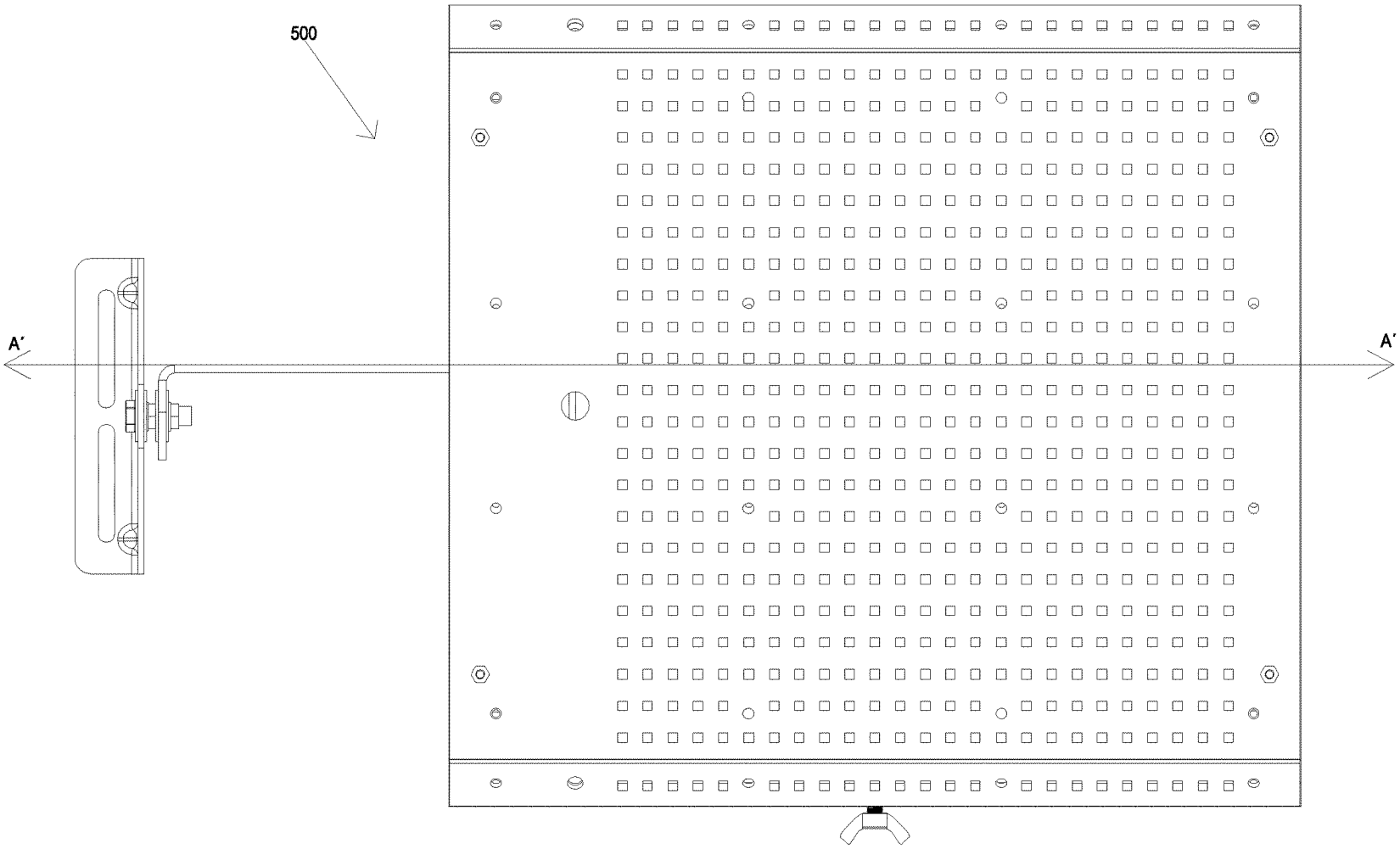
FIG. 25 illustrates a front view of an LED kit according to one implementation.
Figure 26:
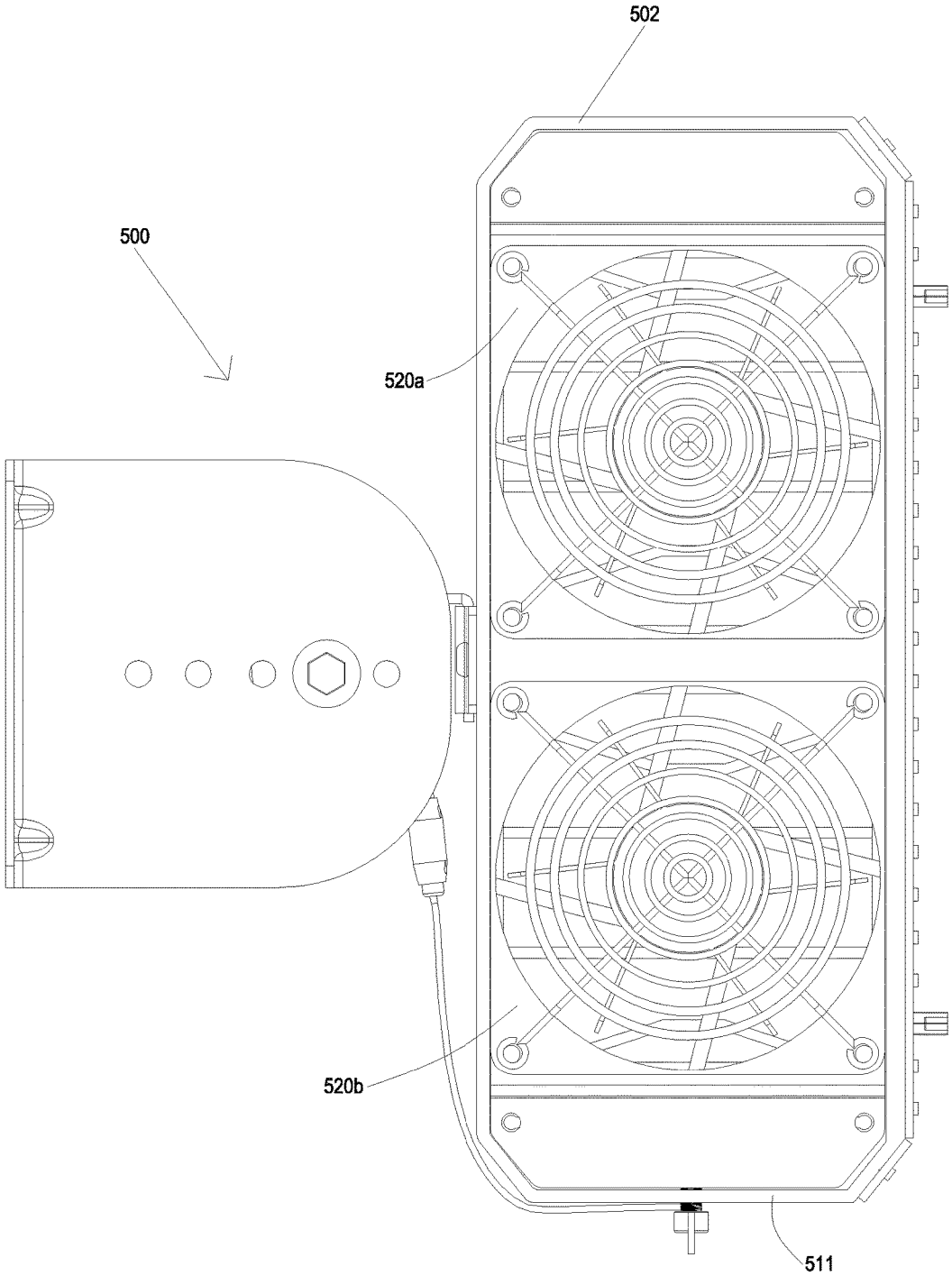
FIG. 26 illustrates a first side view of the LED kit shown in FIG. 25.
Figure 27:
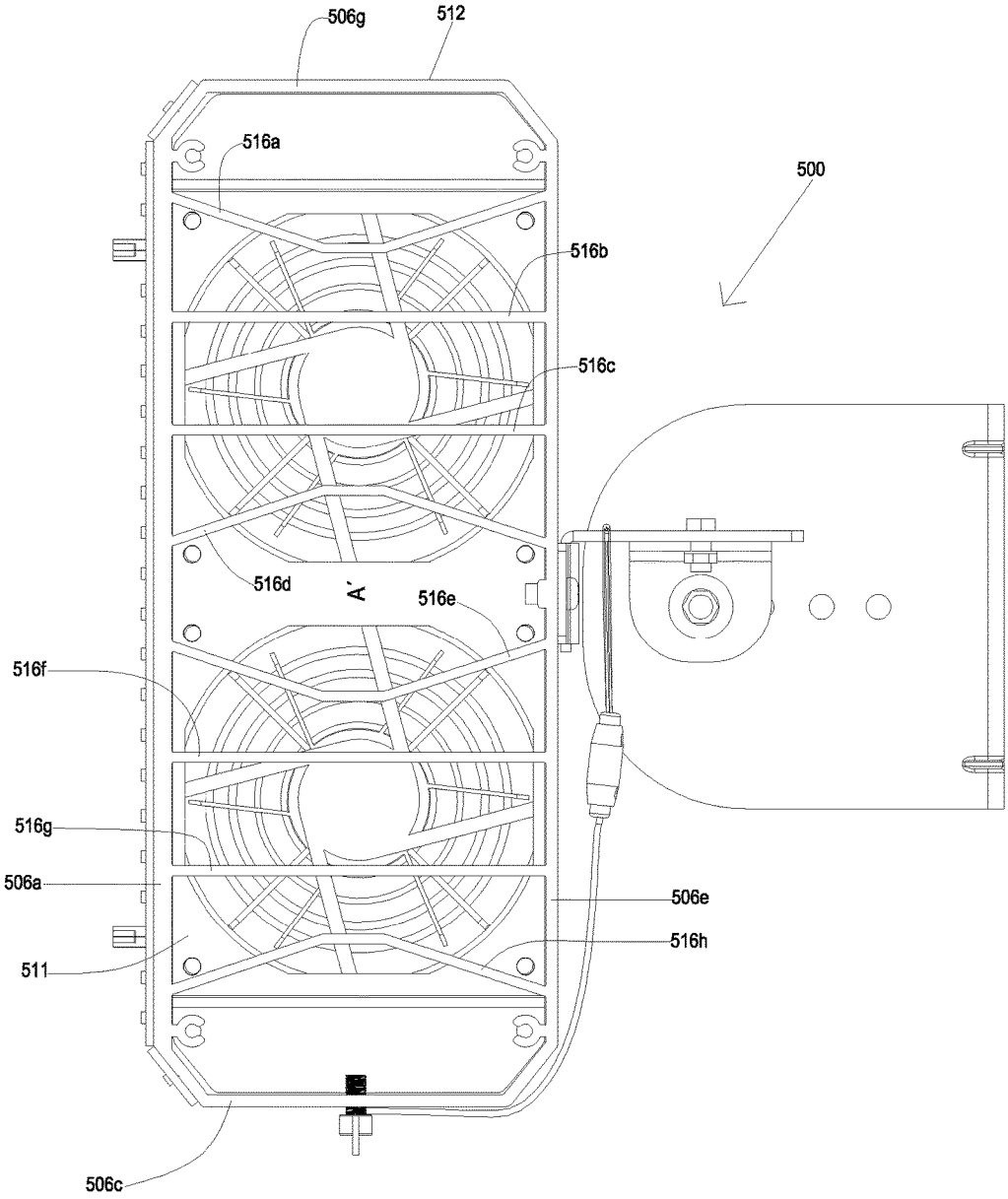
FIG. 27 illustrates a second side view of the LED kit shown in FIG. 26.

The LED kit 500 shown in FIGS. 25-27 includes two fans 520*a*, 520*b* that are disposed adjacent a proximal end 511 of housing 502. The kit 500 also includes eight fins 516*a*-516*h* extending between side walls 506*a* and 506*e*. Fin 516*a* is disposed closest to side wall 506*g* and has a central portion that extends inwardly toward the central axis A'-A' extending through channel 511 of the housing 502. Fin 516*h* is disposed closest to side wall 506*c* and has a central portion that extends inwardly toward the central axis A'-A' extending through the channel 511. Fins 516*e* and 516*d* are spaced apart from each other and are disposed on either side of and closest to the central axis of the channel 511. Fins 516*e* and 516*d* each have a central portion that extends outwardly from the central axis A'-A' extending through the channel 511. Fins 516*b* and 516*c* are spaced apart from each other and disposed between fins 516*a* and 516*d*, and fins 516*b* and 516*c* are straight. Fins 516*f* and 516*g* are spaced apart from each other and disposed between 516*e* and 516*h*, and fins 516*f* and 516*g* are straight.

Figure 28:
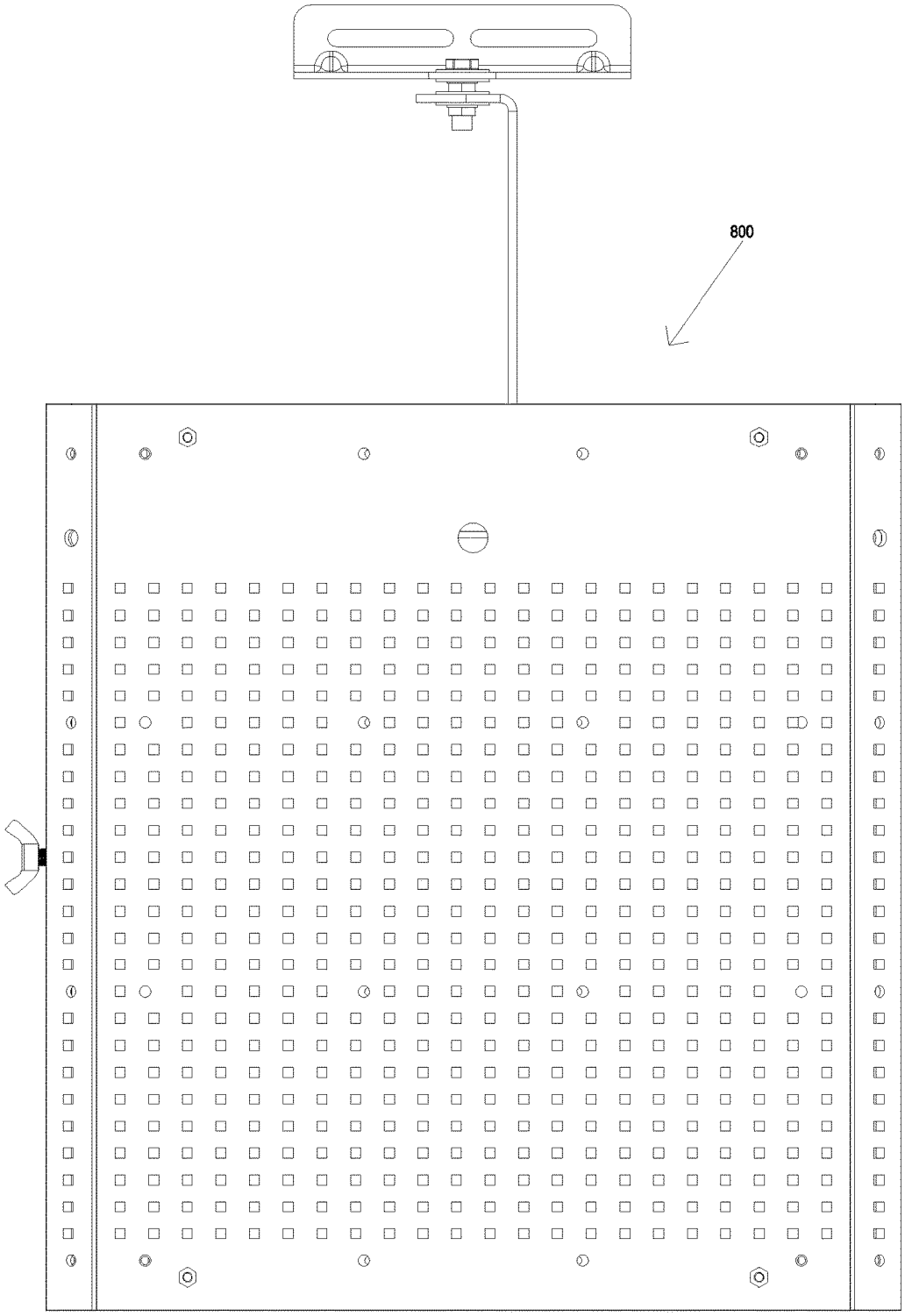
FIG. 28 illustrates a front view of an LED kit according to one implementation.
Figure 29:
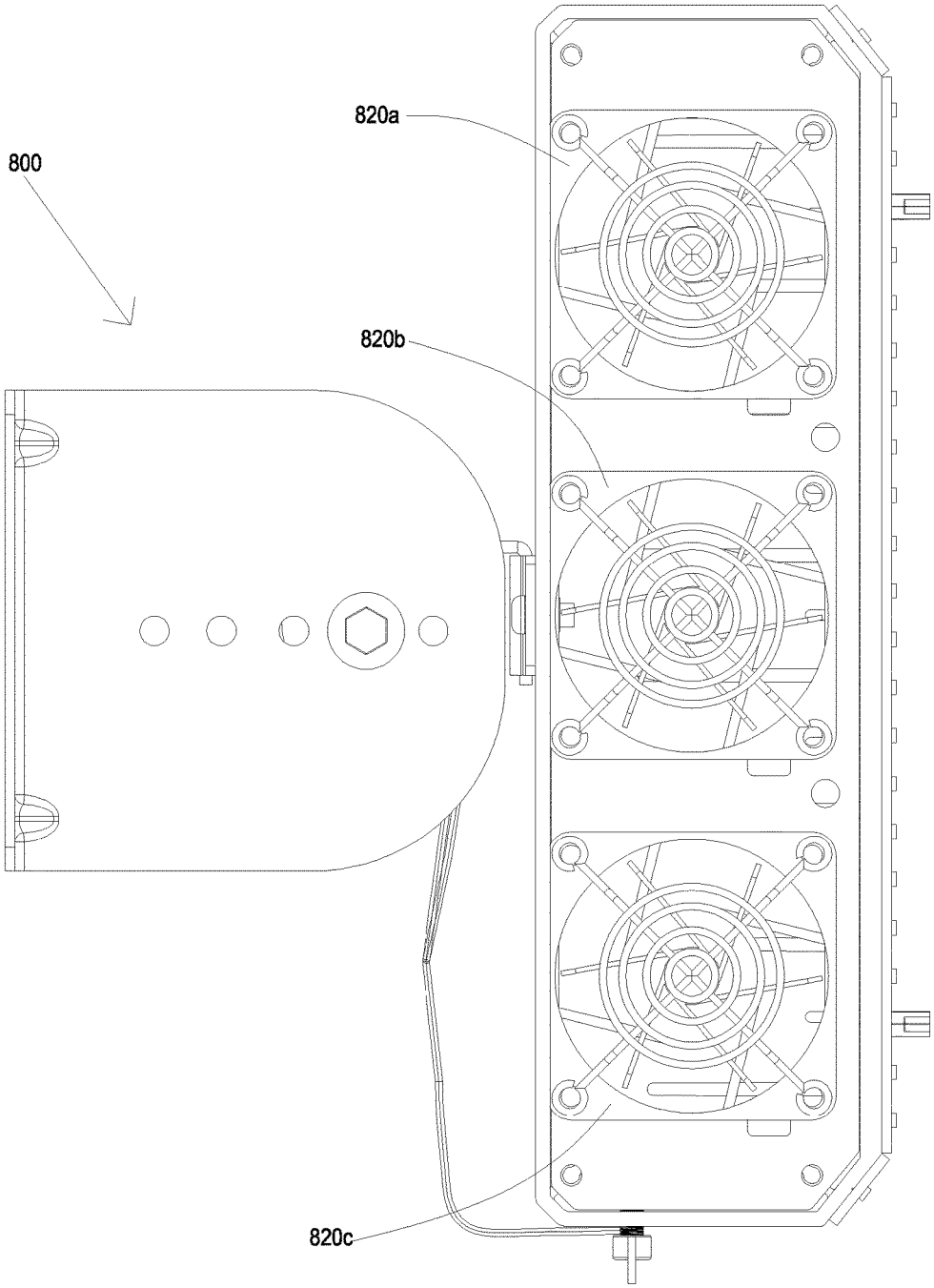
FIG. 29 illustrates a first side view of an LED kit according another implementation.
Figure 30:
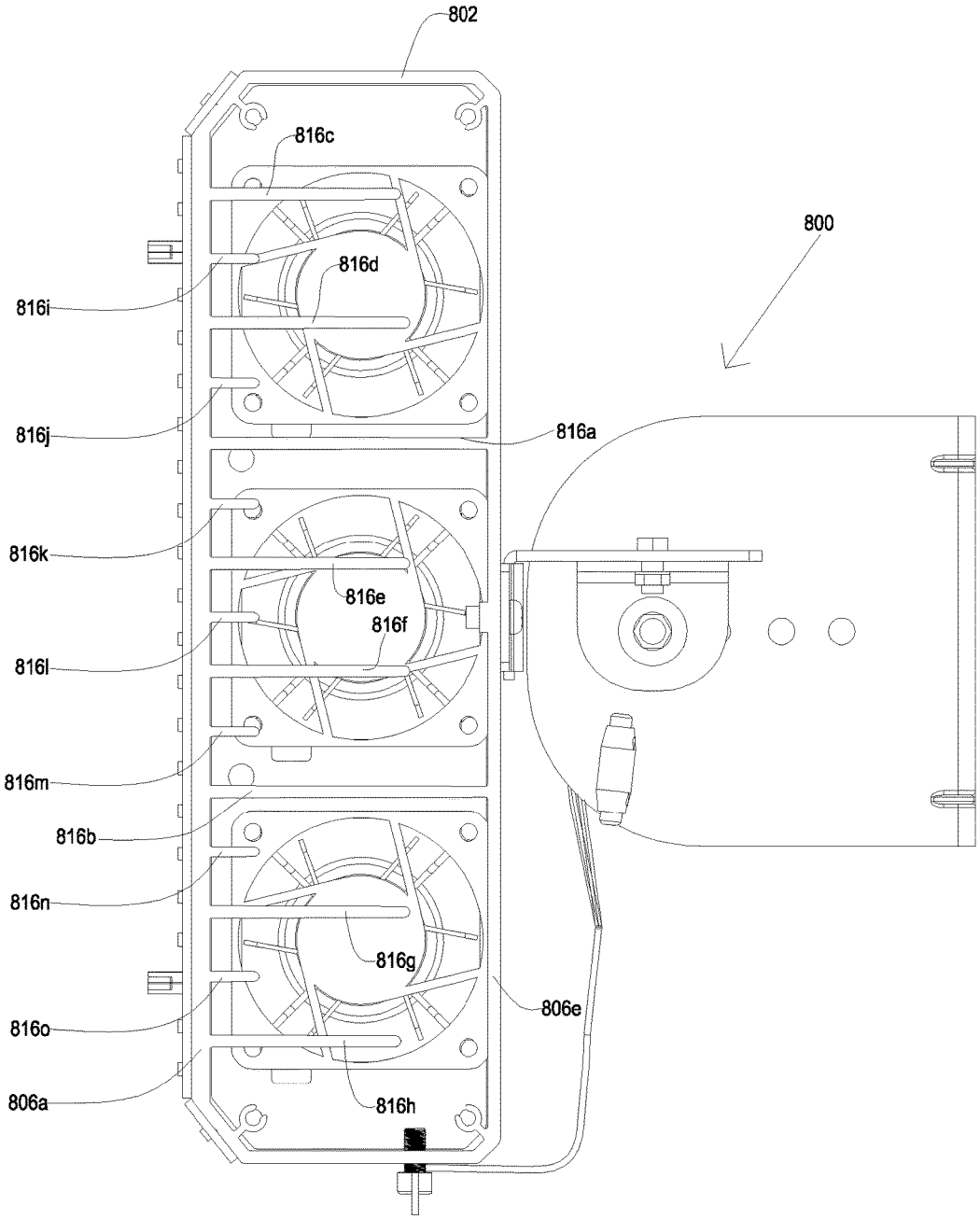
FIG. 30 illustrates a second side view of the LED kit shown in FIG. 29.

The LED kit 800 shown in FIGS. 28-30 has three fans 820*a*, 820*b*, 820*c* that are coupled to proximal end 811 of the housing 802. In the housing 802, there are fifteen fins. Fins 816*a* and 816*b* extend between side walls 806*a* and 806*e*. Fins 816*c*-816*h* extend from side wall 806*a* toward side wall 806*e* a first height but do not intersect side wall 806*e*. Fins 816*l*-816*o* extend from side wall 806*a* toward side wall 806*e* a second amount that is smaller than the first amount and do not intersect side wall 806*e*.

Figure 31:
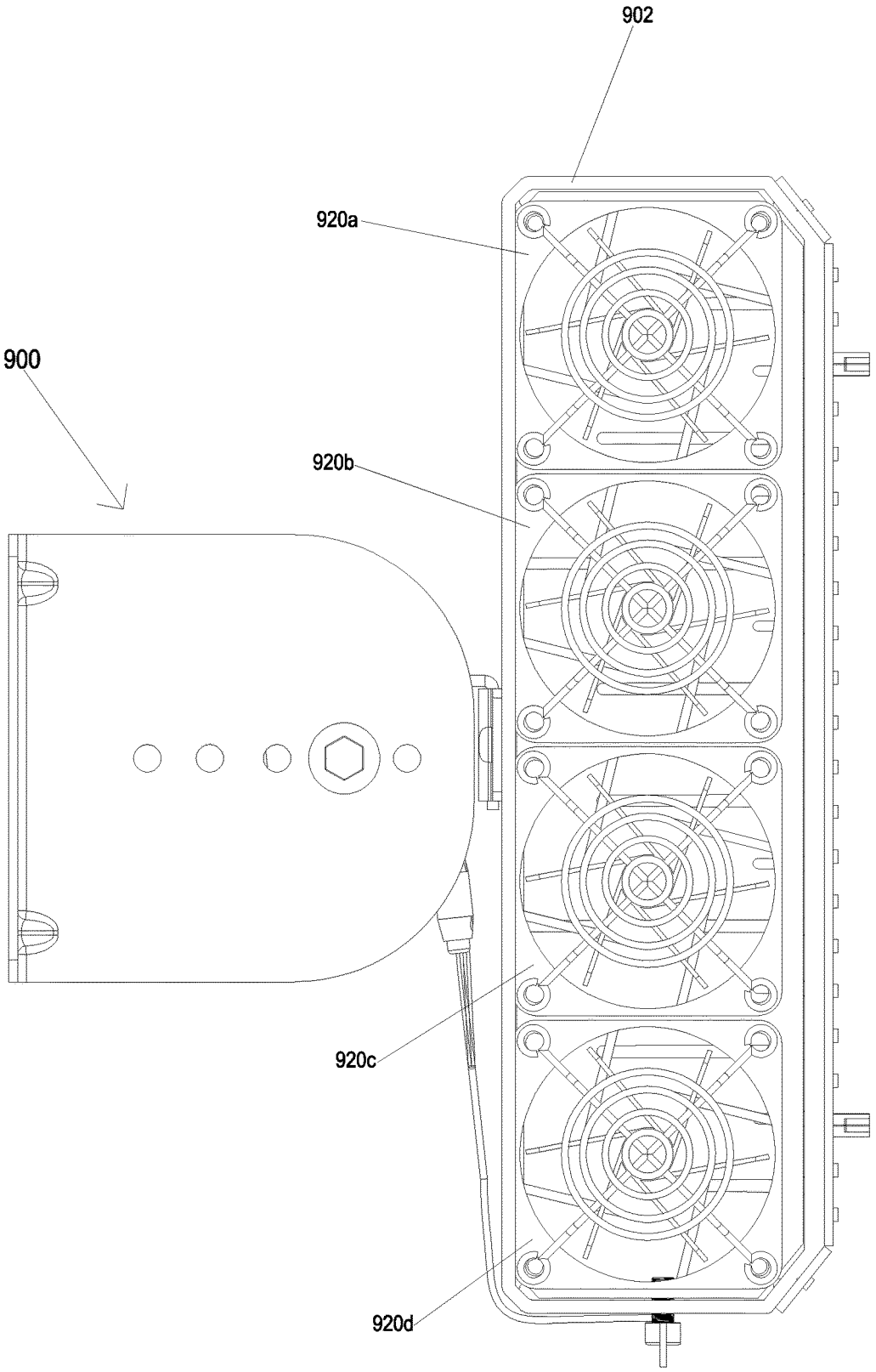
FIG. 31 illustrates a first side view of an LED kit according another implementation.
Figure 32:
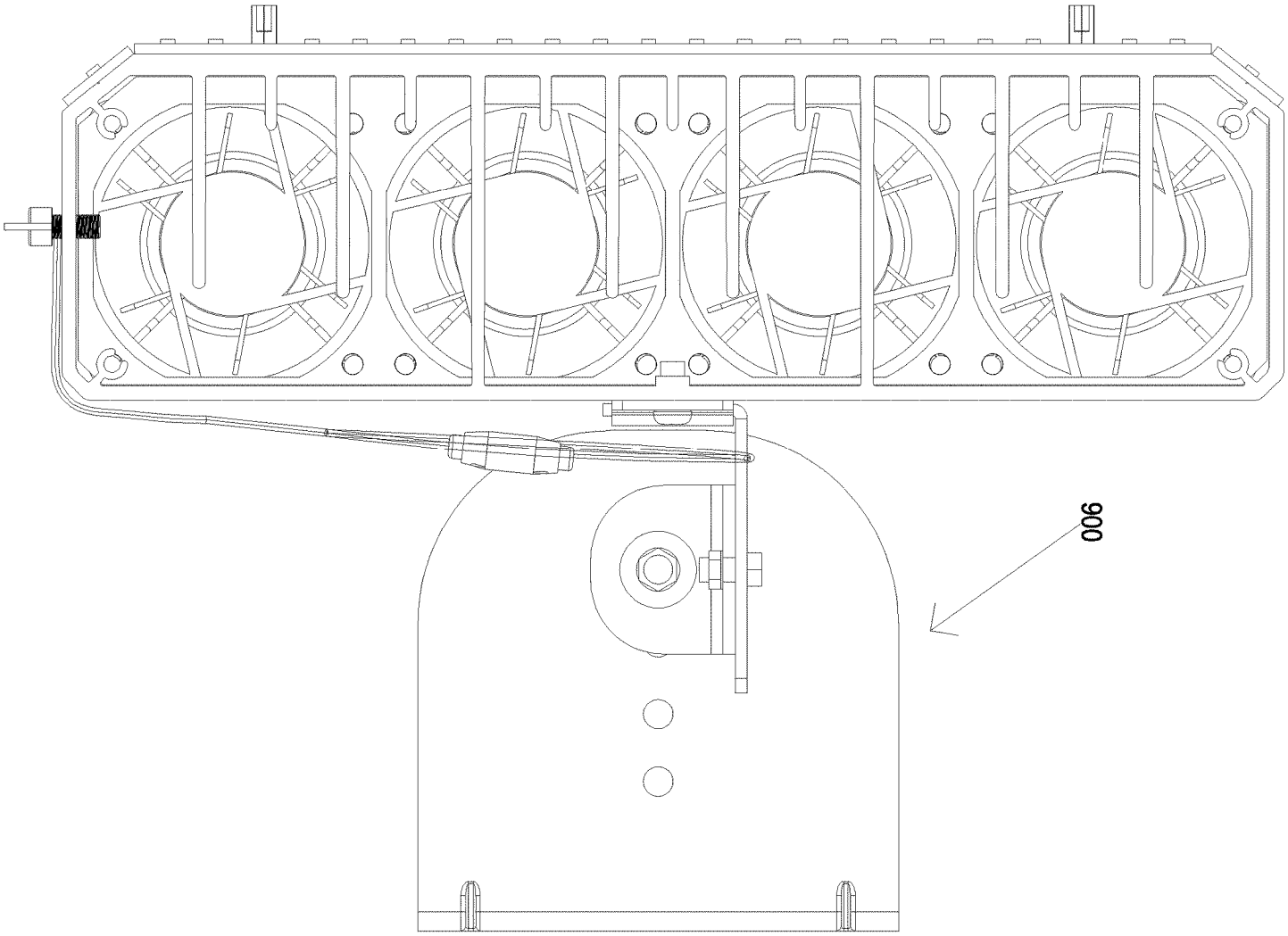
FIG. 32 illustrates a second side view of the LED kit shown in FIG. 31.

The LED kit 900 shown in FIGS. 31-32 has four fans 920*a*, 920*b*, 920*c*, 920*d* that are coupled to one end of the housing 902. The fin arrangements for housing 902 are the same as for housing 802.

Other fin arrangements outside of those described above in relation to FIGS. 1-5 and 8-32, may be provided in other implementations to provide surface area for dissipating heat conducted away from the LEDs. By having fins that extend through the channel in the direction of the central axis of the channel of the housing, air may flow through the channel more quickly, resulting in the heat from the fins being dissipated more quickly, since the air flow direction is not changed and no air leaks out of the housing as it flows from one end of the channel to the other end. In addition, the fans described above may be disposed adjacent the proximal or distal ends of the housing or within the housing between the ends.

Figure 33:
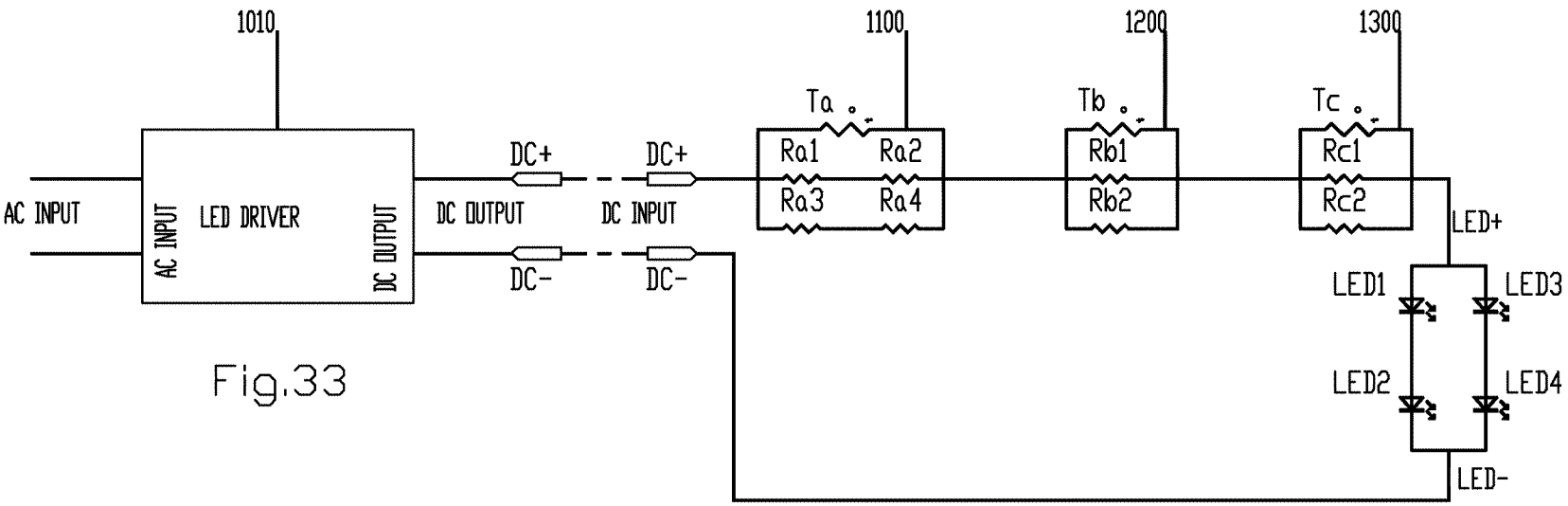
FIG. 33 illustrates a circuit diagram of temperature control circuits on a housing, according to one implementation.

The housing, such as housings 102, 202, 302,302', 302", 502, 602, 602', 702, 802, and 902 described above in relation to FIGS. 1-5 and 8-32, may include two or more temperature control circuits to further regulate the amount of current received by the LEDs. FIGS. 33-37 illustrate an implementation in which three temperature control circuits are electrically coupled in series between a driver 1010 and the LEDs. FIG. 33 is a circuit diagram of the temperature control circuits 1100, 1200, and 1300 before power is supplied to the LEDs. Temperature control circuit 1100 includes a temperature switch associated with an activation temperature Ta and a threshold temperature and two resistance integrated circuits (ICs), Ra3 and Ra4, for reducing the current to the LEDs if the temperature of the housing exceeds the activation temperature Ta for the switch of circuit 1100. Similarly, temperature control circuit 1200 includes a temperature switch associated with an activation temperature Tb and a threshold temperature and a resistance IC, Rb2, for reducing the current to the LEDs if the temperature of the housing exceeds the activation temperature Tb for the switch of circuit 1200. And, temperature control circuit 1300 includes a temperature switch associated with an activation temperature Tc and a threshold temperature and a resistance IC, Rc2, for reducing the current to the LEDs if the temperature of the housing exceeds the activation temperature Tc for the circuit 1300.

The activation temperature Ta of circuit 1100 is lower than the activation temperatures Tb and Tc of circuits 1200 and 1300, respectively, and the activation temperature Tb of circuit 1200 is lower than the activation temperature Tc of circuit 1300. The threshold temperature of circuit 1100 is lower than the threshold temperatures of circuits 1200 and 1300, and the threshold temperature of circuit 1200 is lower than the threshold temperature of circuit 1300.

Figure 34:
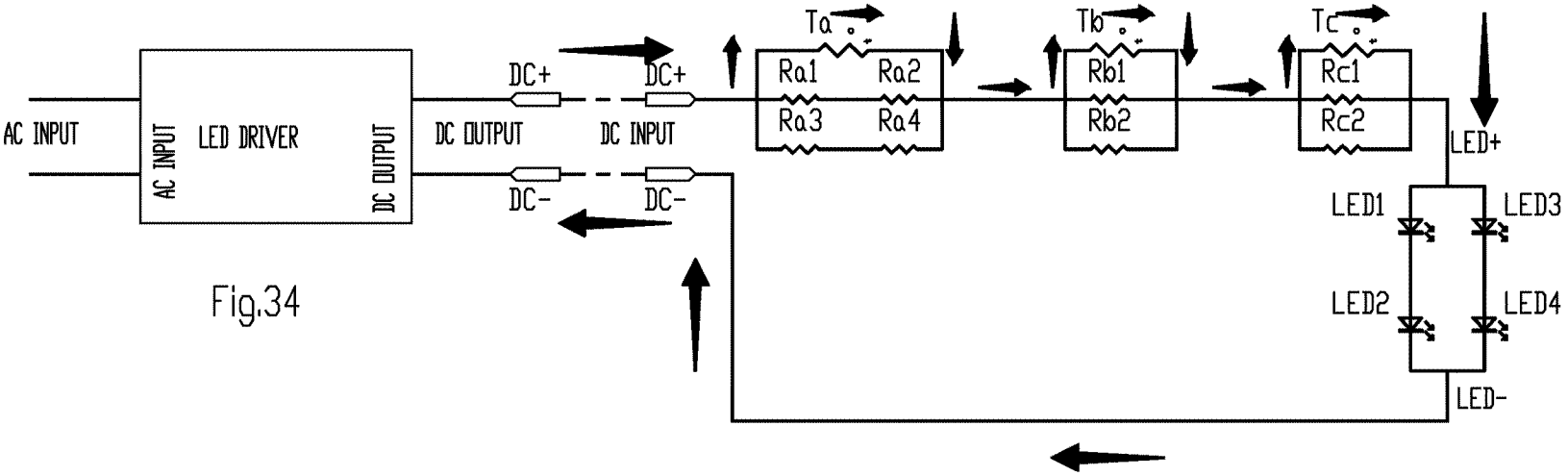
FIG. 34 illustrates the circuit diagram of FIG. 33 when the temperature of the housing is within an acceptable range.

When the temperature of the housing remains below the activation temperature Ta of the switch of circuit 1100, the current flows through resistance ICs Ra1 and Ra2 of circuit 1100, resistance ICs Rb1 of circuit 1200, and resistance ICs Rc1 of circuit 1300. Ra1, Ra2, Rb1, and Rc1 have little to no resistance. This flow is shown in FIG. 34.

Figure 35:
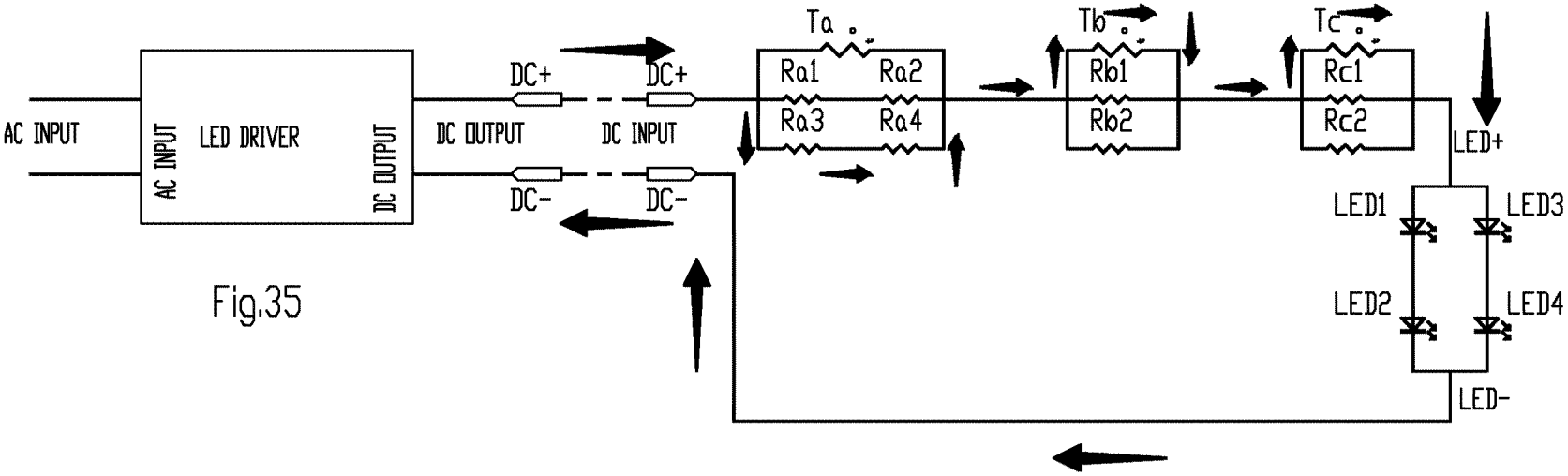
FIG. 35 illustrates the circuit diagram of FIG. 33 when the temperature of the housing exceeds the activation temperature for the temperature switch of circuit 1100.

However, when the temperature switch for circuit 1100 senses that the temperature of the housing is over the activation temperature Ta for the switch, the current is directed to flow through resistance ICs Ra3 and Ra4 instead of resistance ICs Ra1 and Ra2. Resistance ICs Ra3 and Ra4 have a resistance that reduces the current by a certain amount. For example, this current reduction amount may result in about 30% less power being supplied to the LEDs. In addition, the activation temperature Ta for the switch of circuit 1100 may be around 95° C. If the temperature of the housing remains below the activation temperature Tb of the switch for circuit 1200, the current continues to flow through Rb1 and Rd. This is shown in FIG. 35.

Figure 36:
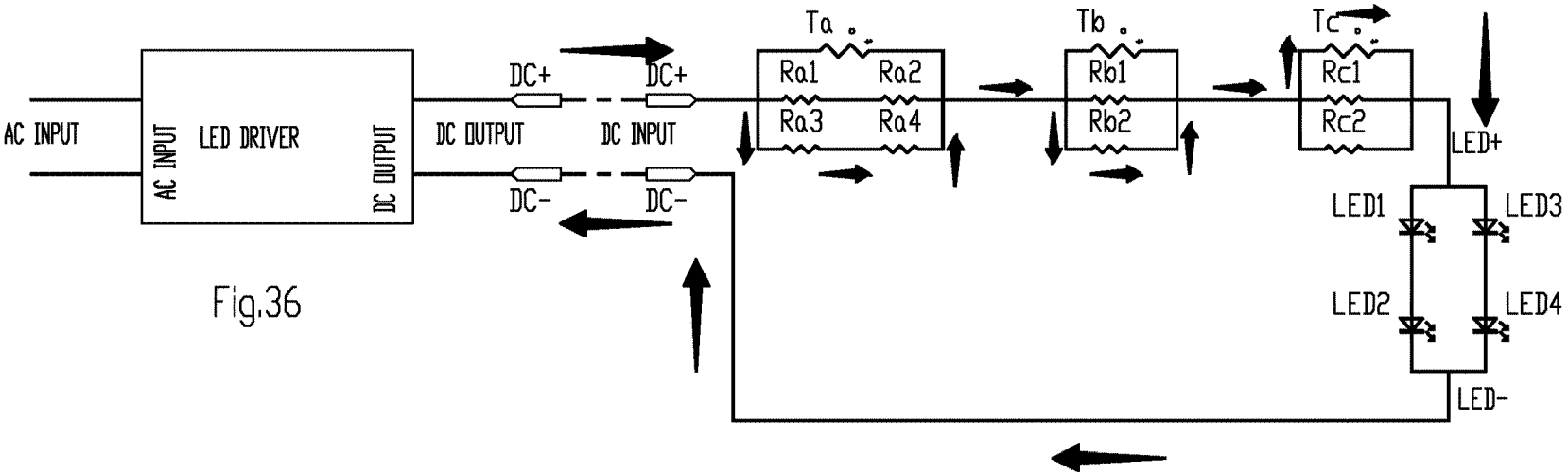
FIG. 36 illustrates the circuit diagram of FIG. 33 when the temperature of the housing exceeds the activation temperature for temperature switch of circuit 1200.

When the temperature switch for circuit 1200 senses that the temperature of the housing is over the activation temperature Tb for the switch of circuit 1200, the current is directed to flow through resistance IC Rb2 instead of resistance IC Rb1. Resistance IC Rb2 has a resistance that reduces the current by a certain amount. For example, this current reduction amount may result in about 20% less power being supplied to the LEDs. Thus, when the temperature of the housing is above the activation temperature Tb for the switch of circuit 1200, the power supplied to the LEDs is reduced by a total of about 50% as it flows through resistance ICs Ra3, Ra4, and Rb2. The activation temperature Tb for the switch of circuit 1200 may be around 105° C. If the temperature of the housing remains below the activation temperature Tc of the switch for circuit 1300, the current continues to flow through Rd. This is shown in FIG. 36.

Figure 37:
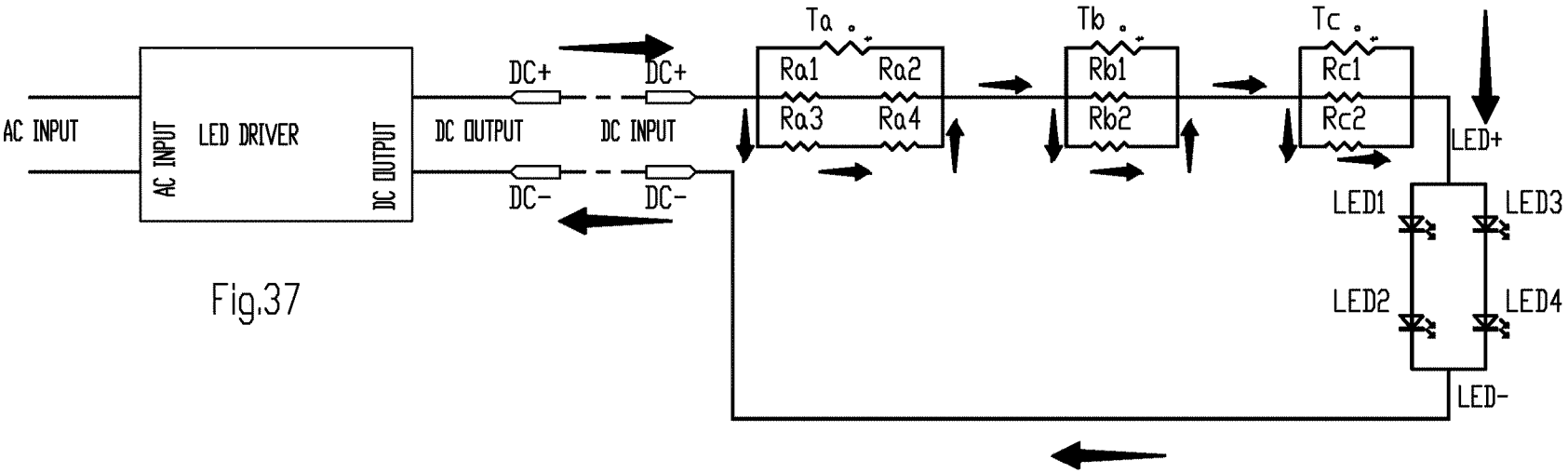
FIG. 37 illustrates the circuit diagram of FIG. 33 when the temperature of the housing exceeds the activation temperature for temperature switch of circuit 1300.

When the temperature switch for circuit 1300 senses that the temperature of the housing is over the activation temperature Tc for the switch of circuit 1300, the current is directed to flow through resistance IC Rc2 instead of resistance IC Rd. Resistance IC Rc2 has a resistance that reduces the current by a certain amount. For example, this current reduction amount may reduce the power supplied to the LEDs by about 30%. Thus, when the temperature of the housing is above the activation temperature Tc for the switch of circuit 1300, the current is reduced by a total of about 80% as it flows through resistance ICs Ra3, Ra4, Rb2, and Rc2. The activation temperature Tc for the switch of circuit 1300 may be around 115° C. This is shown in FIG. 37.

In the circuit diagrams shown in FIGS. 33-37, the temperature switches for each circuit 1100, 1200, 1300 are in an on position when the temperature of the housing is below the activation temperature for the respective switch. When the temperature switch senses that the housing temperature is above the activation temperature for the switch, the switch closes, which causes the current to flow through the respective resistance ICs for the circuit.

The threshold temperature for each switch is the temperature at which the switch goes back to the "on" position. For example, the threshold temperature of the switch of circuit 1300 is about 75° C., the threshold temperature of the switch of circuit 1200 is about 70° C., and the threshold temperature of the switch of circuit 1100 is about 65° C. Thus, if the housing temperature drops to 75° C. or below, the switch of circuit 1300 switches back to the on position, and current flows through resistance IC Rc1 instead of Rc2. If the housing temperature drops to 70° C. or below, the switch of circuit 1200 switches back to the on position, and current flows through resistance IC Rb1 instead of Rb2. And, if the housing temperature drops to 65° C. or below, the switch of circuit 1100 switches back to the on position, and current flows through resistance ICs Ra1 and Rat instead of Ra3 and Ra4.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The implementation was chosen and described in order to best explain the principles of the invention and the practical application, and to enable others of ordinary skill in the art to understand the invention for various implementations with various modifications as are suited to the particular use contemplated.

The invention claimed is:

1. An LED kit comprising:

a housing having a plurality of walls, each wall having an inner and an outer surface, the inner and outer surfaces of each wall being opposite and spaced apart from each other, the walls being integrally formed, and the plurality of walls comprising a front wall and a rear wall;

at least one LED unit coupled to the outer surface of the front wall of the housing;

a base bracket attached to the outer surface of the rear wall; and a bracket coupled to the base bracket, wherein:

the inner surfaces of the walls define a channel having a closed perimeter, the inner surfaces of the walls together defining a first opening to the channel at a first end of the housing and a second opening to the channel at a second end of the housing, the first and second ends being spaced apart from and opposite each other along a central axis that extends through the openings and is orthogonal to a direction of light output from the at least one LED unit, the inner surfaces of the walls defining the channel extend a length of the channel between the first and second ends of the housing in the direction of the central axis, a heat sink structure is integrally formed with and extends inwardly into the channel from the inner surface of at least one of the walls, the rear wall is opposite and spaced apart from the front wall relative to the central axis, wherein the outer surface of the rear wall is planar, and at least one electrically powered cooling device disposed inside the first or second opening of the channel, wherein the electrically powered cooling device causes air flow from one of the first or second opening to the other of the second or first opening through the channel and along the central axis and across the heat sink structure.

2. The LED kit of claim 1, wherein the electrically powered cooling device comprises a fan, and a plane in which the fan rotates is parallel to the light output direction.

3. The LED kit of claim 1, wherein the at least one electrically powered cooling device comprises a first fan and a second fan disposed inside the first opening, wherein a first plane in which the first fan rotates and a second plane in which the second fan rotates are parallel to the light output direction.

4. The LED kit of claim 1, wherein the at least one electrically powered cooling device comprises a first fan and a second fan, the first fan being disposed inside the first opening and the second fan being disposed inside the second opening, wherein a first plane in which the first fan rotates and a second plane in which the second fan rotates are parallel to the light output direction.

5. The LED kit of claim 1, wherein the heat sink structure comprises fins extending from the inner surface.

6. The LED kit of claim 5, wherein the fins extend from the inner surface of the front wall.

7. The LED kit of claim 1, wherein the walls further comprise a third wall and a fourth wall, the third and fourth walls lying in planes that are orthogonal to the planes in which the front and rear walls lie, wherein the heat sink structure extends from the inner surfaces of the front, rear, third, and fourth walls.

8. The LED kit of claim 7, wherein the walls further comprise fifth, sixth, seventh, and eighth walls, the fifth wall being between the front and third walls, the sixth wall being between the third and rear walls, the seventh wall being between the rear and fourth walls, and the eighth wall being between the fourth and front walls, wherein the first and second openings are octagonally shaped.

9. The LED kit of claim 7, wherein the LED unit is a first LED unit disposed on the outer surface of the front wall, and the at least one LED unit further comprises a second LED unit disposed adjacent the fifth wall and a third LED unit disposed adjacent the sixth wall.

10. The LED kit of claim 8, wherein the walls further comprise fifth, sixth, seventh, and eighth walls, the fifth wall being between the front and third walls, the sixth wall being between the third and rear walls, the seventh wall being between the rear and fourth walls, and the eighth wall being between the fourth and front walls, wherein the first and second openings are octagonally shaped.

11. The LED kit of claim 10, wherein the LED unit is a first LED unit disposed on the outer surface of the front wall, and the at least one LED unit further comprises a second LED unit disposed adjacent the fifth wall and a third LED unit disposed adjacent the sixth wall.

12. An LED kit comprising:

a housing having a plurality of walls, each wall having an inner and an outer surface, the inner and outer surfaces of each wall being opposite and spaced apart from each other, the walls being integrally formed, the inner surfaces of the walls defining a channel having a closed perimeter, the inner surfaces of the walls defining a first opening to the channel at a first end of the housing and a second opening to the channel at a second end of the housing, the first and second ends being spaced apart from and opposite each other along a central axis of the channel extending through the openings, and the inner surfaces of the walls defining the channel extending a length of the channel between the first and second ends of the housing in the direction of the central axis; and at least one LED unit coupled to the outer surface of a first wall of the housing, wherein light output from the LED unit is orthogonal to the direction of the central axis, a base bracket attached to an outer surface of a second wall of the plurality of walls of the housing, wherein at least one bracket is coupled to the base bracket, the bracket being mountable to a light fixture housing by engaging a fastener into aligned openings defined by the bracket and the light fixture.

13. The LED kit of claim 12, wherein:

the first and second walls are opposite and spaced apart from each other relative to the central axis.

14. The LED kit of claim 12, wherein the bracket comprises a first L-shaped bracket that is coupled to the base bracket and a second L-shaped bracket that is coupled to the first L-shaped bracket.

15. The LED kit of claim 14, wherein a central portion of the base bracket is spaced apart from the outer surface of the second wall and a first leg of the first L-shaped bracket is insertable between the central portion of the base bracket and the outer surface of the second wall.

16. The LED kit of claim 14, wherein the first L-shaped bracket has a first axis that extends orthogonally to the outer surface of the second wall, and the second L-shaped bracket has a second axis and is coupled to the first L-shaped bracket such that the second axis is at an angle of about 180° or less to the first axis.

17. The LED kit of claim 14, wherein the bracket further comprises a third L-shaped bracket that is coupled to the second L-shaped bracket, the fastener comprises a screw, and the third L-shaped bracket is mountable to the light fixture by engaging the screw into the aligned openings defined by the third L-shaped bracket and the light fixture.

18. An LED kit comprising:

a housing having a plurality of walls, each wall having an inner and an outer surface, the inner and outer surfaces of each wall being opposite and spaced apart from each other, the walls being integrally formed; and at least one LED unit coupled to the outer surface of at least one of the plurality of walls of the housing, wherein:

the inner surfaces of the walls define a channel having a closed perimeter, the inner surfaces of the walls together defining a first opening to the channel at a first end of the housing and a second opening to the channel at a second end of the housing, the first and second ends being spaced apart from and opposite each other along a central axis of the channel that extends through the openings and is orthogonal to a direction of light output from the at least one LED unit, the inner surfaces of the walls defining the channel extend a length of the channel between the first and second ends of the housing in the direction of the central axis, and at least one electrically powered cooling device is disposed adjacent the first or second opening, the electrically powered cooling device causing air to flow through the channel from one of the first or second opening to the other of the second or first opening along the central axis of the channel.

19. The LED kit of claim 18, wherein:

the plurality of walls comprises a first wall and a second wall, and the housing further comprises an inner wall extending between the inner surface of the first wall and the second wall, the inner wall dividing the channel into a first channel and a second channel.

20. The LED kit of claim 19, wherein the at least one electrically powered cooling device comprises a first fan and a second fan, the first fan being disposed adjacent the first opening of the first channel, and the second fan being disposed adjacent the first opening of the second channel.

* * * * *